US012571068B2

(12) United States Patent
Minami et al.

(10) Patent No.: US 12,571,068 B2
(45) Date of Patent: Mar. 10, 2026

(54) CONTINUOUS ANNEALING LINE, CONTINUOUS HOT-DIP GALVANIZING LINE, AND STEEL SHEET PRODUCTION METHOD

(71) Applicant: JFE STEEL CORPORATION, Tokyo (JP)

(72) Inventors: Hidekazu Minami, Tokyo (JP); Kazuki Endoh, Tokyo (JP); Yuki Toji, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 463 days.

(21) Appl. No.: 18/005,186

(22) PCT Filed: May 11, 2021

(86) PCT No.: PCT/JP2021/017938

§ 371 (c)(1),
(2) Date: Jan. 12, 2023

(87) PCT Pub. No.: WO2022/014131

PCT Pub. Date: Jan. 20, 2022

(65) Prior Publication Data

US 2023/0265539 A1 Aug. 24, 2023

(30) Foreign Application Priority Data

Jul. 14, 2020 (JP) ..... 2020-120969
Jul. 14, 2020 (JP) ..... 2020-120972

(51) Int. Cl.
*C21D 9/56* (2006.01)
*C21D 1/04* (2006.01)
(Continued)

(52) U.S. Cl.
CPC ..... *C21D 9/562* (2013.01); *C21D 1/04* (2013.01); *C21D 1/26* (2013.01); *C21D 3/06* (2013.01);
(Continued)

(58) Field of Classification Search
CPC ... C21D 1/04; C21D 1/26; C21D 1/74; C21D 2241/00; C21D 3/06; C21D 6/005;
(Continued)

(56) References Cited

U.S. PATENT DOCUMENTS 3,421,925 A * 1/1969 Hair ..... C21D 8/125 427/127
2007/0051438 A1* 3/2007 Honda ..... C23C 2/0224 148/533
(Continued)

FOREIGN PATENT DOCUMENTS

CN 108474059 A 8/2018
CN 110546293 A 12/2019
(Continued)

OTHER PUBLICATIONS

Feb. 28, 2025, Office Action issued by the China National Intellectual Property Administration in the corresponding Chinese Patent Application No. 202180049828.4 with English language search report.
(Continued)

*Primary Examiner* — Nicholas A Wang
(74) *Attorney, Agent, or Firm* — KENJA IP LAW PC

(57) ABSTRACT

Provided is a continuous annealing line capable of producing a steel sheet excellent in hydrogen embrittlement resistance. A continuous annealing line 100 comprises: a payoff reel 10 configured to uncoil a cold-rolled coil C to feed a cold-rolled steel sheet S; an annealing furnace 20 configured to continuously anneal the cold-rolled steel sheet S and
(Continued)

including a heating zone 22, a soaking zone 24, and a cooling zone 26 that are arranged from an upstream side in a sheet passing direction; a downstream line 30 configured to continuously pass the cold-rolled steel sheet S discharged from the annealing furnace 20 therethrough; a tension reel 50 configured to coil the cold-rolled steel sheet S; and a sound wave irradiator 60 configured to irradiate the cold-rolled steel sheet S being passed from the cooling zone 26 to the tension reel 50 with sound waves.

8 Claims, 6 Drawing Sheets

(51) Int. Cl.

| | |
|---|---|
| ***C21D 1/26*** | (2006.01) |
| ***C21D 3/06*** | (2006.01) |
| ***C21D 6/00*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C23C 2/26*** | (2006.01) |
| ***C23C 2/28*** | (2006.01) |
| ***C23C 2/40*** | (2006.01) |

(52) U.S. Cl.
CPC ..... *C21D 6/005* (2013.01); *C21D 6/008* (2013.01); *C21D 9/46* (2013.01); *C21D 9/561* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C23C 2/26* (2013.01); *C23C 2/28* (2013.01); *C23C 2/29* (2022.08); *C23C 2/40* (2013.01); *C21D 2241/00* (2013.01); *C22C 2202/04* (2013.01)

(58) Field of Classification Search
CPC ..... C21D 6/008; C21D 8/0205; C21D 9/005; C21D 9/0062; C21D 9/46; C21D 9/561; C21D 9/562; C21D 9/564; C21D 9/56; C22C 2202/04; C22C 38/001; C22C 38/002; C22C 38/005; C22C 38/008; C22C 38/02; C22C 38/04; C22C 38/06; C22C 38/08; C22C 38/12; C22C 38/14; C22C 38/16; C22C 38/38; C22C 38/42; C22C 38/44; C22C 38/58; C22C 38/60; C23C 2/06; C23C 2/26; C23C 2/28; C23C 2/29; C23C 2/40
See application file for complete search history.

(56) References Cited

U.S. PATENT DOCUMENTS

| | | | | |
|---|---|---|---|---|
| 2019/0024208 | A1 | 1/2019 | Kitazawa et al. | |
| 2020/0190617 | A1* | 6/2020 | Hasegawa ..... | C21D 8/0257 |
| 2020/0299800 | A1 | 9/2020 | Nishida et al. | |
| 2021/0010101 | A1 | 1/2021 | Endo et al. | |
| 2021/0010115 | A1 | 1/2021 | Yoshitomi et al. | |
| 2021/0388477 | A1* | 12/2021 | Miono ..... | C23C 2/00342 |

FOREIGN PATENT DOCUMENTS

| | | | | |
|---|---|---|---|---|
| EP | 3421625 | A1 | | 1/2019 |
| EP | 3878998 | A1 | | 9/2021 |
| JP | H01279740 | | * | 11/1989 |
| JP | H0633150 | | * | 2/1994 |
| JP | H0633150 | A | | 2/1994 |
| JP | 2003290811 | A | | 10/2003 |
| JP | 2004131794 | A | | 4/2004 |
| JP | WO2018124157 | | * | 7/2018 |
| JP | 2019173099 | A | | 10/2019 |
| WO | 2017145322 | A1 | | 8/2017 |
| WO | 2019188642 | A1 | | 10/2019 |
| WO | 2019189842 | A1 | | 10/2019 |
| WO | 2020095939 | A1 | | 5/2020 |

OTHER PUBLICATIONS

Tang Di, Advanced High Strength Strip Steel for Automobile, Oct. 2016, p. 67, Metallurgical Industry Press.

Aug. 30, 2022, Notification of Reasons for Refusal issued by the Japan Patent Office in the corresponding Japanese Patent Application No. 2021-544942 with English language Concise Statement of Relevance.

Jul. 20, 2021, International Search Report issued in the International Patent Application No. PCT/JP2021/017938.

Jun. 6, 2023, the Extended European Search Report issued by the European Patent Office in the corresponding European Patent Application No. 21842184.0.

* cited by examiner

Simultaneously with cooling

Simultaneously with cooling

Simultaneously with cooling

Immediately before and immediately after cooling

Immediately before cooling

In between cooling

Immediately after cooling

Simultaneously with cooling

CONTINUOUS ANNEALING LINE, CONTINUOUS HOT-DIP GALVANIZING LINE, AND STEEL SHEET PRODUCTION METHOD

TECHNICAL FIELD

The present disclosure relates to a continuous annealing line, a continuous hot-dip galvanizing line, and a steel sheet production method. The present disclosure particularly relates to a continuous annealing line, a continuous hot-dip galvanizing line, and a steel sheet production method for producing a steel sheet that has low hydrogen content in steel and excellent hydrogen embrittlement resistance and is suitable for use in the fields of automobiles, home electric appliances, building materials, etc.

BACKGROUND

For example, when producing an annealed steel sheet in a continuous annealing line and when producing a hot-dip galvanized steel sheet in a continuous hot-dip galvanizing line, a steel sheet is annealed in a reducing atmosphere containing hydrogen. During this annealing, hydrogen enters into the steel sheet. Hydrogen present in the steel sheet lowers the formability of the steel sheet, such as ductility, bendability, and stretch flangeability. Hydrogen present in the steel sheet also embrittles the steel sheet, and can cause a delayed fracture. A treatment for reducing the hydrogen content in the steel sheet is therefore needed.

For example, by leaving, at room temperature, a product coil produced in a continuous annealing line or a continuous hot-dip galvanizing line, the hydrogen content in the steel can be reduced. However, at room temperature, it takes time for hydrogen to move from the inside to the surface of the steel sheet and desorb from the surface. Accordingly, the product coil needs to be left at room temperature for at least several weeks, in order to sufficiently reduce the hydrogen content in the steel. The space and time required for such dehydrogenation treatment pose a problem in the production process.

WO 2019/188642 A1 (PTL 1) discloses a method of reducing the hydrogen content in steel by holding an annealed steel sheet, a hot-dip galvanized steel sheet, or a galvannealed steel sheet in a temperature range of 50° C. or more and 300° C. or less for 1800 seconds or more and 43200 seconds or less.

CITATION LIST

Patent Literature

PTL 1: WO 2019/188642 A1

SUMMARY

Technical Problem

With the method described in PTL 1, however, there is concern that microstructural changes by heating may cause changes in mechanical properties such as yield stress increase and temper embrittlement.

It could therefore be helpful to provide a continuous annealing line, a continuous hot-dip galvanizing line, and a steel sheet production method capable of producing a steel sheet excellent in hydrogen embrittlement resistance without changing the mechanical properties and without impairing the production efficiency.

Solution to Problem

Upon careful examination, we discovered the following: After annealing a steel sheet in a reducing atmosphere containing hydrogen in a continuous annealing line (CAL) or a continuous hot-dip galvanizing line (CGL), by irradiating the steel sheet being continuously passed with sound waves in a cooling process from the annealing temperature to room temperature, hydrogen in the steel sheet can be reduced sufficiently and efficiently. This is presumed to be due to the following mechanism: By irradiating the steel sheet with sound waves to forcibly microvibrate the steel sheet, the steel sheet undergoes repeated bending deformation. As a result, the lattice spacing of the surface expands as compared with the mid-thickness part of the steel sheet. Hydrogen in the steel sheet diffuses toward the surface of the steel sheet with wide lattice spacing and low potential energy, and desorbs from the surface.

The present disclosure is based on these discoveries. We thus provide:

[1] A continuous annealing line comprising: a payoff reel configured to uncoil a cold-rolled coil to feed a cold-rolled steel sheet; an annealing furnace configured to pass the cold-rolled steel sheet therethrough to continuously anneal the cold-rolled steel sheet and including a heating zone, a soaking zone, and a cooling zone that are arranged from an upstream side in a sheet passing direction, the cold-rolled steel sheet being annealed in a reducing atmosphere containing hydrogen in the heating zone and the soaking zone, and cooled in the cooling zone; a downstream line configured to continuously pass the cold-rolled steel sheet discharged from the annealing furnace therethrough; a tension reel configured to coil the cold-rolled steel sheet being passed through the downstream line; and a sound wave irradiator configured to irradiate the cold-rolled steel sheet being passed from the cooling zone to the tension reel with sound waves.

[2] The continuous annealing line according to [1], wherein the sound wave irradiator is located in the cooling zone.

[3] The continuous annealing line according to [1] or [2], wherein the sound wave irradiator is located at a position that enables irradiating the cold-rolled steel sheet being passed through the downstream line with the sound waves.

[4] The continuous annealing line according to any one of [1] to [3], wherein an intensity of the sound waves generated from the sound wave irradiator and a position of the sound wave irradiator are set so that a sound pressure level at a surface of the cold-rolled steel sheet will be 30 dB or more.

[5] The continuous annealing line according to any one of [1] to [4], wherein the sound wave irradiator is capable of irradiation with the sound waves having a frequency from 10 Hz to 100000 Hz.

[6] The continuous annealing line according to any one of [1] to [5], wherein an arrangement of the sound wave irradiator and a sheet passing speed of the cold-rolled steel sheet are set so that a sound wave irradiation time for the cold-rolled steel sheet will be 1 second or more.

[7] A continuous hot-dip galvanizing line comprising: the continuous annealing line according to [1]; and a hot-dip galvanizing bath located, as the downstream line, downstream of the annealing furnace in the sheet passing direction, and configured to immerse the cold-rolled steel sheet therein to apply a hot-dip galvanized coating onto the cold-rolled steel sheet.

[8] The continuous hot-dip galvanizing line according to [7], wherein the sound wave irradiator is located at a position that enables irradiating the cold-rolled steel sheet being passed upstream of the hot-dip galvanizing bath with the sound waves.

[9] The continuous hot-dip galvanizing line according to [7] or [8], wherein the sound wave irradiator is located at a position that enables irradiating the cold-rolled steel sheet being passed downstream of the hot-dip galvanizing bath with the sound waves.

[10] The continuous hot-dip galvanizing line according to [7], comprising an alloying furnace located, as the downstream line, downstream of the hot-dip galvanizing bath in the sheet passing direction, and configured to pass the cold-rolled steel sheet therethrough to heat and alloy the hot-dip galvanized coating.

[11] The continuous hot-dip galvanizing line according to [10], wherein the sound wave irradiator is located at a position that enables irradiating the cold-rolled steel sheet being passed upstream of the hot-dip galvanizing bath with the sound waves.

[12] The continuous hot-dip galvanizing line according to [10] or [11], wherein the sound wave irradiator is located at a position that enables irradiating the cold-rolled steel sheet being passed downstream of the hot-dip galvanizing bath with the sound waves.

[13] The continuous hot-dip galvanizing line according to any one of [7] to [12], wherein an intensity of the sound waves generated from the sound wave irradiator and a position of the sound wave irradiator are set so that a sound pressure level at a surface of the cold-rolled steel sheet will be 30 dB or more.

[14] The continuous hot-dip galvanizing line according to any one of [7] to [13], wherein the sound wave irradiator is capable of irradiation with the sound waves having a frequency from 10 Hz to 100000 Hz.

[15] The continuous hot-dip galvanizing line according to any one of [7] to [14], wherein an arrangement of the sound wave irradiator and a sheet passing speed of the cold-rolled steel sheet are set so that a sound wave irradiation time for the cold-rolled steel sheet will be 1 second or more.

[16] A steel sheet production method comprising, in the following order: a step (A) of uncoiling a cold-rolled coil to feed a cold-rolled steel sheet by a payoff reel; a step (B) of passing the cold-rolled steel sheet through an annealing furnace in which a heating zone, a soaking zone, and a cooling zone are arranged from an upstream side in a sheet passing direction, to continuously anneal the cold-rolled steel sheet by a step (B-1) of annealing the cold-rolled steel sheet in a reducing atmosphere containing hydrogen in the heating zone and the soaking zone and a step (B-2) of cooling the cold-rolled steel sheet in the cooling zone; a step (C) of continuously passing the cold-rolled steel sheet discharged from the annealing furnace; and a step (D) of coiling the cold-rolled steel sheet by a tension reel to obtain a product coil, wherein the steel sheet production method comprises a sound wave irradiation step of irradiating the cold-rolled steel sheet being passed in or after the step (B-2) and before the step (D) with sound waves so that a sound pressure level at a surface of the cold-rolled steel sheet will be 30 dB or more.

[17] The steel sheet production method according to [16], wherein the sound wave irradiation step is performed in the step (B-2).

[18] The steel sheet production method according to [16] or [17], wherein the sound wave irradiation step is performed in the step (C).

[19] The steel sheet production method according to [16], wherein the step (C) includes a step (C-1) of immersing the cold-rolled steel sheet in a hot-dip galvanizing bath located downstream of the annealing furnace in the sheet passing direction to apply a hot-dip galvanized coating onto the cold-rolled steel sheet.

[20] The steel sheet production method according to [19], wherein the sound wave irradiation step is performed before the step (C-1).

[21] The steel sheet production method according to [19] or [20], wherein the sound wave irradiation step is performed after the step (C-1).

[22] The steel sheet production method according to [19], wherein the step (C) includes, following the step (C-1), a step (C-2) of passing the cold-rolled steel sheet through an alloying furnace located downstream of the hot-dip galvanizing bath in the sheet passing direction to heat and alloy the hot-dip galvanized coating.

[23] The steel sheet production method according to [22], wherein the sound wave irradiation step is performed before the step (C-1).

[24] The steel sheet production method according to [22] or [23], wherein the sound wave irradiation step is performed after the step (C-1).

[25] The steel sheet production method according to any one of [16] to [24], wherein the sound waves have a frequency from 10 Hz to 100000 Hz.

[26] The steel sheet production method according to any one of [16] to [25], wherein in the sound wave irradiation step, a sound wave irradiation time for the cold-rolled steel sheet is 1 second or more.

[27] The steel sheet production method according to any one of [16] to [26], wherein the cold-rolled steel sheet is a high strength steel sheet having a tensile strength of 590 MPa or more.

[28] The steel sheet production method according to any one of [16] to [27], wherein the cold-rolled steel sheet has a chemical composition containing (consisting of), in mass %, C: 0.030% to 0.800%, Si: 0.01% to 3.00%, Mn: 0.01% to 10.00%, P: 0.001% to 0.100%, S: 0.0001% to 0.0200%, N: 0.0005% to 0.0100%, and Al: 0.001% to 2.000%, with the balance being Fe and inevitable impurities.

[29] The steel sheet production method according to [28], wherein the chemical composition further contains, in mass %, at least one element selected from the group consisting of Ti: 0.200% or less, Nb: 0.200% or less, V: 0.500% or less, W: 0.500% or less, B: 0.0050% or less, Ni: 1.000% or less, Cr: 1.000% or less, Mo: 1.000% or less, Cu: 1.000% or less, Sn: 0.200% or less, Sb: 0.200% or less, Ta: 0.100% or less, Ca: 0.0050% or less, Mg: 0.0050% or less, Zr: 0.1000% or less, and REM: 0.0050% or less.

[30] The steel sheet production method according to any one of [16] to [26], wherein the cold-rolled steel sheet is a stainless steel sheet having a chemical composition containing (consisting of), in mass %, C: 0.001% to 0.400%, Si: 0.01% to 2.00%, Mn: 0.01% to 5.00%, P: 0.001% to 0.100%, S: 0.0001% to 0.0200%, Cr: 9.0% to 28.0%, Ni: 0.01% to 40.0%, N: 0.0005% to 0.500%, and Al: 0.001% to 3.000%, with the balance being Fe and inevitable impurities.

[31] The steel sheet production method according to [30], wherein the chemical composition further contains, in mass %, at least one element selected from the group consisting of Ti: 0.500% or less, Nb: 0.500% or less, V: 0.500% or less, W: 2.000% or less, B: 0.0050% or less, Mo: 2.000% or less, Cu: 3.000% or less, Sn: 0.500% or less, Sb: 0.200% or less, Ta: 0.100% or less, Ca: 0.0050% or less, Mg: 0.0050% or less, Zr: 0.1000% or less, and REM: 0.0050% or less.

[32] The steel sheet production method according to any one of [16] to [31], wherein the product coil has a diffusible hydrogen content of 0.50 mass ppm or less.

Advantageous Effect

It is thus possible to provide a continuous annealing line, a continuous hot-dip galvanizing line, and a steel sheet production method capable of producing a steel sheet excellent in hydrogen embrittlement resistance without changing the mechanical properties and without impairing the production efficiency.

DETAILED DESCRIPTION

One embodiment of the present disclosure relates to a continuous annealing line (CAL), and another embodiment of the present disclosure relates to a continuous hot-dip galvanizing line (CGL).

A steel sheet production method according to one embodiment of the present disclosure is implemented by a continuous annealing line (CAL) or a continuous hot-dip galvanizing line (CGL).

Figure 1:
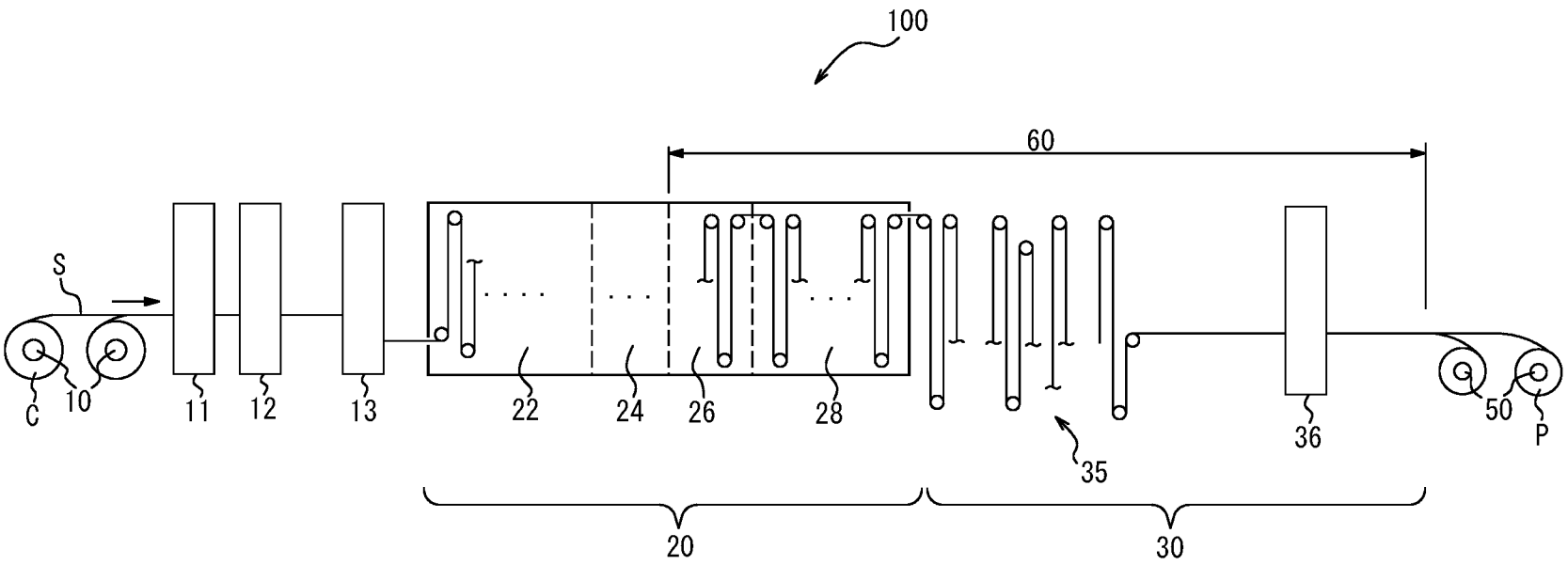
FIG. 1 is a schematic view of a continuous annealing line 100 according to one embodiment of the present disclosure.

With reference to FIG. 1, a continuous annealing line (CAL) 100 according to Embodiment 1 of the present disclosure comprises: a payoff reel 10 configured to uncoil a cold-rolled coil C to feed a cold-rolled steel sheet S; an annealing furnace 20 configured to pass the cold-rolled steel sheet S therethrough to continuously anneal the cold-rolled steel sheet S; a downstream line 30 configured to continuously pass the cold-rolled steel sheet S discharged from the annealing furnace 20 therethrough; and a tension reel 50 configured to coil the cold-rolled steel sheet S being passed through the downstream line 30 to obtain a product coil P. In the annealing furnace 20, a heating zone 22, a soaking zone 24, and a cooling zone 26 are arranged from the upstream side in the sheet passing direction. In the heating zone 22 and the soaking zone 24, the cold-rolled steel sheet S is annealed in a reducing atmosphere containing hydrogen. In the cooling zone 26, the cold-rolled steel sheet S is cooled. The annealing furnace 20 in the CAL 100 preferably includes an overaging treatment zone 28 downstream of the cooling zone 26, although the overaging treatment zone 28 is not essential. In the overaging treatment zone 28, the cold-rolled steel sheet S is subjected to an overaging treatment. In this embodiment, the CAL 100 produces a product coil of a cold-rolled and annealed steel sheet (CR).

With reference to FIG. 1, a steel sheet production method according to Embodiment 1 implemented by the continuous annealing line (CAL) 100 comprises, in the following order: a step (A) of uncoiling a cold-rolled coil C to feed a cold-rolled steel sheet (steel strip) S by the payoff reel 10; a step (B) of passing the cold-rolled steel sheet S through the annealing furnace 20 in which the heating zone 22, the soaking zone 24, and the cooling zone 26 are arranged from the upstream side in the sheet passing direction, to continuously anneal the cold-rolled steel sheet S by a step (B-1) of annealing the cold-rolled steel sheet S in a reducing atmosphere containing hydrogen in the heating zone 22 and the soaking zone 24 and a step (B-2) of cooling the cold-rolled steel sheet S in the cooling zone 26; a step (C) of continuously passing the cold-rolled steel sheet S discharged from the annealing furnace 20; and a step (D) of coiling the cold-rolled steel sheet S by the tension reel 50 to obtain a product coil P. In the continuous annealing step (B) by the annealing furnace 20 in the CAL 100, it is preferable to perform a step (B-3) of subjecting the cold-rolled steel sheet S to an overaging treatment by the overaging treatment zone 28 optionally located downstream of the cooling zone 26, although this step is not essential. This embodiment is a method of producing a product coil of a cold-rolled and annealed steel sheet (CR) by the CAL 100.

Figure 2:
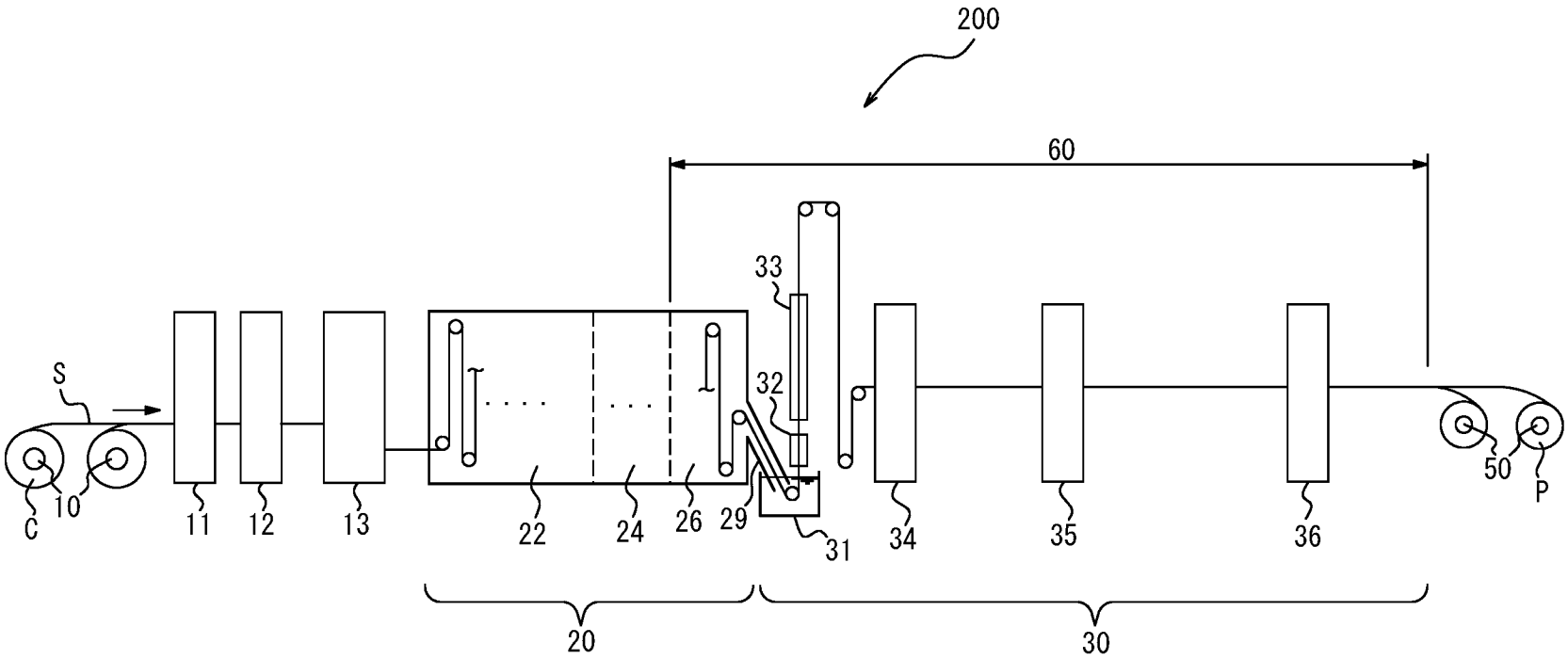
FIG. 2 is a schematic view of a continuous hot-dip galvanizing line 200 according to one embodiment of the present disclosure.

With reference to FIG. 2, a continuous hot-dip galvanizing line (CGL) 200 according to Embodiment 2 of the present disclosure comprises: a payoff reel 10 configured to uncoil a cold-rolled coil C to feed a cold-rolled steel sheet S; an annealing furnace 20 configured to pass the cold-rolled steel sheet S therethrough to continuously anneal the cold-rolled steel sheet S; a downstream line 30 configured to continuously pass the cold-rolled steel sheet S discharged from the annealing furnace 20 therethrough; and a tension reel 50 configured to coil the cold-rolled steel sheet S being passed through the downstream line 30 to obtain a product coil P. In the annealing furnace 20, a heating zone 22, a soaking zone 24, and a cooling zone 26 are arranged from the upstream side in the sheet passing direction. In the heating zone 22 and the soaking zone 24, the cold-rolled steel sheet S is annealed in a reducing atmosphere containing hydrogen. In the cooling zone 26, the cold-rolled steel sheet S is cooled. The CGL 200 further comprises, as the downstream line 30: a hot-dip galvanizing bath 31 located downstream of the annealing furnace 20 in the sheet passing direction and configured to immerse the cold-rolled steel sheet S therein to apply a hot-dip galvanized coating onto the cold-rolled steel sheet S; and an alloying furnace 33 located downstream of the hot-dip galvanizing bath 31 in the sheet passing direction and configured to pass the cold-rolled steel sheet S therethrough to heat and alloy the hot-dip galvanized coating. In this embodiment, the CGL 200 produces a product coil of a galvannealed steel sheet (GA) whose galvanized layer is alloyed. In the case where the steel sheet S is simply passed through the alloying furnace 33 without being heated and alloyed, a product coil of a hot-dip galvanized steel sheet (GI) whose galvanized layer is not alloyed is produced.

With reference to FIG. 2, a steel sheet production method according to Embodiment 2 implemented by the continuous hot-dip galvanizing line (CGL) 200 comprises, in the following order: a step (A) of uncoiling a cold-rolled coil C to feed a cold-rolled steel sheet (steel strip) S by the payoff reel 10; a step (B) of passing the cold-rolled steel sheet S through the annealing furnace 20 in which the heating zone 22, the soaking zone 24, and the cooling zone 26 are arranged from the upstream side in the sheet passing direction, to continuously anneal the cold-rolled steel sheet S by a step (B-1) of annealing the cold-rolled steel sheet S in a reducing atmosphere containing hydrogen in the heating zone 22 and the soaking zone 24 and a step (B-2) of cooling the cold-rolled steel sheet S in the cooling zone 26; a step (C) of continuously passing the cold-rolled steel sheet S discharged from the annealing furnace 20; and a step (D) of coiling the cold-rolled steel sheet S by the tension reel 50 to obtain a product coil P. The step (C) includes: a step (C-1) of immersing the cold-rolled steel sheet S in the hot-dip galvanizing bath 31 located downstream of the annealing furnace 20 in the sheet passing direction to apply a hot-dip galvanized coating onto the cold-rolled steel sheet S; and a step (C-2) of, following the step (C-1), passing the cold-rolled steel sheet S through the alloying furnace 33 located downstream of the hot-dip galvanizing bath 31 in the sheet passing direction to heat and alloy the hot-dip galvanized coating. This embodiment is a method of producing a product coil of a galvannealed steel sheet (GA) whose galvanized layer is alloyed, by the CGL 200.

Figure 3:
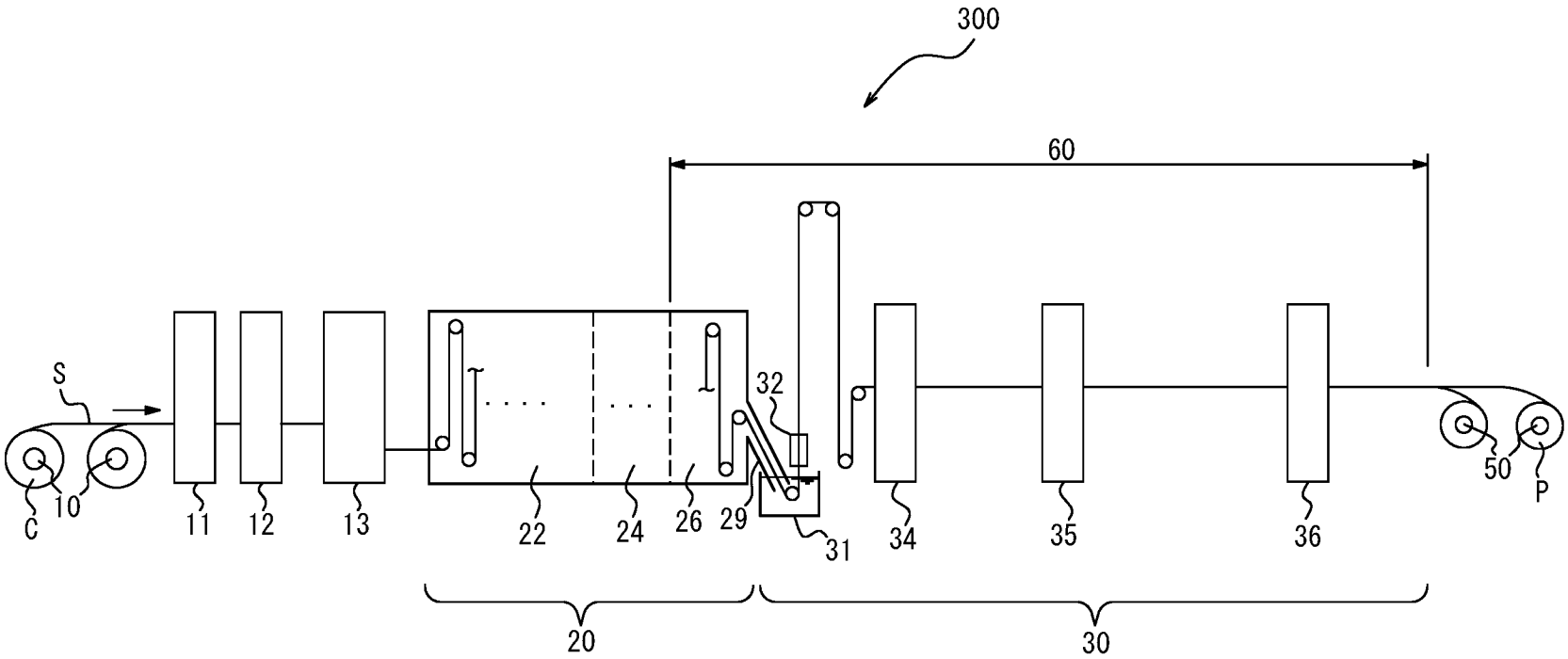
FIG. 3 is a schematic view of a continuous hot-dip galvanizing line 300 according to another embodiment of the present disclosure.

With reference to FIG. 3, a continuous hot-dip galvanizing line (CGL) 300 according to Embodiment 3 of the present disclosure has the same structure as the CGL 200 except that the alloying furnace 33 is not included. In this embodiment, the CGL 300 produces a product coil of a hot-dip galvanized steel sheet (GI) whose galvanized layer is not alloyed.

That is, a steel sheet production method according to Embodiment 3 that includes the step (C-1) but does not include the step (C-2) is, for example, implemented by the CGL 300 not including the alloying furnace 33 or by a method that simply passes the steel sheet S through the alloying furnace 33 in the CGL 200 without heating and alloying it. This embodiment is a method of producing a product coil of a hot-dip galvanized steel sheet (GI) whose galvanized layer is not alloyed, by the CGL 200 or the CGL 300.

Each component in the CAL according to Embodiment 1 and the CGLs according to Embodiments 2 and 3 will be described in detail below. Moreover, each step in the steel sheet production methods according to Embodiments 1 to 3 will be described in detail below.

[Payoff Reel, and Line from Payoff Reel to Annealing Furnace]

[Step (A)]

With reference to FIGS. 1 to 3, the payoff reel 10 uncoils the cold-rolled coil C to feed the cold-rolled steel sheet S. That is, in the step (A), the cold-rolled coil C is uncoiled to feed the cold-rolled steel sheet S by the payoff reel 10. The cold-rolled steel sheet S fed is passed through a welder 11, a cleaning line 12, and an entry looper 13 and supplied to the annealing furnace 20. The upstream line between the payoff reel 10 and the annealing furnace 20 is, however, not limited to the welder 11, the cleaning line 12, and the entry looper 13, and may be a known line or any line.

[Annealing Furnace]

[Step (B)]

With reference to FIGS. 1 to 3, the annealing furnace 20 passes the cold-rolled steel sheet S therethrough to continuously anneal the cold-rolled steel sheet S. In the annealing furnace 20, the heating zone 22, the soaking zone 24, and the cooling zone 26 are arranged from the upstream side in the sheet passing direction. In the heating zone 22 and the soaking zone 24, the cold-rolled steel sheet S is annealed in a reducing atmosphere containing hydrogen. In the cooling zone 26, the cold-rolled steel sheet S is cooled. That is, in the step (B), the cold-rolled steel sheet S is passed through the annealing furnace 20 in which the heating zone 22, the soaking zone 24, and the cooling zone 26 are arranged from the upstream side in the sheet passing direction, to continuously anneal the cold-rolled steel sheet S. The cooling zone 26 may be composed of a plurality of cooling zones. A preheating zone may be provided upstream of the heating zone 22 in the sheet passing direction. The annealing furnace 20 in the CAL 100 illustrated in FIG. 1 preferably includes the overaging treatment zone 28 downstream of the cooling zone 26, although the overaging treatment zone 28 is not essential. Although each zone is illustrated as a vertical furnace in FIGS. 1 to 3, the zone is not limited to such, and may be a horizontal furnace. In the case of a vertical furnace, adjacent zones communicate with each other through a throat (restriction portion) that connects the upper parts or lower parts of the respective zones.

(Heating Zone)

In the heating zone 22, the cold-rolled steel sheet S can be directly heated using a burner, or indirectly heated using a radiant tube (RT) or an electric heater. Heating by induction heating, roll heating, electrical resistance heating, direct resistance heating, salt bath heating, electron beam heating, etc. is also possible. The average temperature inside the heating zone 22 is preferably 500° C. to 800° C. The gas from the soaking zone 24 flows into the heating zone 22, and simultaneously a reducing gas is supplied to the heating zone 22. As the reducing gas, a $H_2$—$N_2$ mixed gas is usually used, such as a gas (dew point: about −60° C.) having a composition containing $H_2$: 1 vol % to 35 vol % with the balance being one or both of $N_2$ and Ar and inevitable impurities.

(Soaking Zone)

In the soaking zone 24, the cold-rolled steel sheet S can be indirectly heated using a radiant tube (RT). The average temperature inside the soaking zone 24 is preferably 600° C. to 950° C. A reducing gas is supplied to the soaking zone 24. As the reducing gas, a $H_2$—$N_2$ mixed gas is usually used, such as a gas (dew point: about −60° C.) having a composition containing $H_2$: 1 vol % to 35 vol % with the balance being one or both of $N_2$ and Ar and inevitable impurities.

(Cooling Zone)

In the cooling zone 26, the cold-rolled steel sheet S is cooled by gas, a mixture of gas and water, or water. The cold-rolled steel sheet S is cooled to about 100° C. to 400° C. in the CAL and about 470° C. to 530° C. in the CGL, at the stage of leaving the annealing furnace 20. As illustrated in FIGS. 6A to 6H, a plurality of cooling nozzles 26A are arranged in the cooling zone 26 along the steel sheet conveyance path. For example, each of the cooling nozzles 26A is a circular pipe longer than the width of the steel sheet as described in JP 2010-185101 A, and is installed so that the extending direction of the circular pipe will be parallel to the transverse direction of the steel sheet. The circular pipe has, in a part facing the steel sheet, a plurality of through-holes at certain intervals in the extending direction of the circular pipe, and the water inside the circular pipe is jetted from the through-holes toward the steel sheet. A plurality of cooling nozzle pairs (for example, five to ten pairs) each of which are located to face the front and back of the steel sheet are arranged at certain intervals along the steel sheet conveyance path to form one cooling zone. Approximately three to six cooling zones are preferably arranged along the steel sheet conveyance path.

(Overaging Treatment Zone)

With reference to FIG. 1, in the overaging treatment zone 28 in the CAL 100, the cold-rolled steel sheet S that has left the cooling zone 26 is subjected to at least one treatment out of isothermal holding, reheating, furnace cooling, and natural cooling. The cold-rolled steel sheet S is cooled to about 100° C. to 400° C. at the stage of leaving the annealing furnace 20.

[Downstream Line]

[Step (C)]

With reference to FIGS. 1 to 3, in the step (C), the cold-rolled steel sheet S discharged from the annealing furnace 20 is continuously passed through the downstream line 30. With reference to FIG. 1, the CAL 100 includes an exit looper 35 and a temper mill 36 as the downstream line 30. With reference to FIG. 2, the CGL 200 includes the hot-dip galvanizing bath 31, a gas wiping device 32, the alloying furnace 33, a cooling device 34, the exit looper 35, and the temper mill 36 as the downstream line 30. With reference to FIG. 3, the CGL 300 includes the hot-dip galvanizing bath 31, the gas wiping device 32, the cooling device 34, the exit looper 35, and the temper mill 36 as the downstream line 30. The downstream line 30 is, however, not limited to such, and may be a known line or any line. Examples of the downstream line 30 include a tension leveler, a chemical conversion treatment line, a surface control line, an oiling line, and an inspection line.

(Hot-Dip Galvanizing Bath)

(Step (C-1))

With reference to FIGS. 2 and 3, the hot-dip galvanizing bath 31 is located downstream of the annealing furnace 20 in the sheet passing direction, and immerses the cold-rolled steel sheet S therein to apply a hot-dip galvanized coating onto the cold-rolled steel sheet S. That is, in the step (C-1), the cold-rolled steel sheet S is immersed in the hot-dip galvanizing bath 31 located downstream of the annealing furnace 20 in the sheet passing direction, to apply a hot-dip galvanized coating onto the cold-rolled steel sheet S. A snout 29 connected to the most downstream zone (the cooling zone 26 in FIGS. 2 and 3) of the annealing furnace is a member having a rectangular cross section perpendicular to the sheet passing direction and defining the space through which the cold-rolled steel sheet S passes. The tip of the snout 29 is immersed in the hot-dip galvanizing bath 31, thereby connecting the annealing furnace 20 and the hot dip galvanizing bath 31. The hot-dip galvanizing may be performed according to a usual method.

A pair of gas wiping devices 32 arranged so that the cold-rolled steel sheet S pulled up from the hot-dip galvanizing bath 31 will be interposed therebetween blow a gas onto the cold-rolled steel sheet S, with it being possible to adjust the coating weight of molten zinc on both sides of the cold-rolled steel sheet S.

(Alloying Furnace)

(Step (C-2))

With reference to FIG. 2, the alloying furnace 33 is located downstream of the hot-dip galvanizing bath 31 and the gas wiping device 32 in the sheet passing direction, and passes the cold-rolled steel sheet S therethrough to heat and alloy the hot-dip galvanized coating. That is, in the step (C-2), the cold-rolled steel sheet S is passed through the alloying furnace 33 located downstream of the hot-dip galvanizing bath 31 and the gas wiping device 32 in the sheet passing direction, to heat and alloy the hot-dip galvanized coating. The alloying treatment may be performed according to a usual method. The heating means in the alloying furnace 33 is not limited, and examples include heating with high-temperature gas and induction heating. The alloying furnace 33 is an optional line in the CGL, and the alloying step is an optional step in the steel sheet production method using the CGL.

(Cooling Device)

With reference to FIGS. 2 and 3, the cooling device 34 is located downstream of the gas wiping device 32 and the alloying furnace 33 in the sheet passing direction, and passes the cold-rolled steel sheet S therethrough to cool the cold-rolled steel sheet S. The cooling device 34 cools the cold-rolled steel sheet S by water cooling, air cooling, gas cooling, mist cooling, or the like.

[Tension Reel]

[Step (D)]

With reference to FIGS. 1 to 3, the cold-rolled steel sheet S that has passed through the downstream line 30 is eventually coiled into a product coil P by the tension reel 50 as a coiler.

[Sound Wave Irradiator and Sound Wave Irradiation Step]

It is important that each of the CAL 100 according to Embodiment 1, the CGL 200 according to Embodiment 2, and the CGL 300 according to Embodiment 3 comprises a sound wave irradiator 60 configured to irradiate the cold-rolled steel sheet S being passed from the cooling zone 26 to the tension reel 50 with sound waves. That is, it is important that each of the steel sheet production methods according to Embodiments 1 to 3 comprises a sound wave irradiation step of irradiating the cold-rolled steel sheet S being passed in or after the step (B-2) and before the step (D) with sound waves. Consequently, hydrogen contained in the cold-rolled steel sheet S as a result of annealing can be reduced sufficiently and efficiently, and a steel sheet excellent in hydrogen embrittlement resistance can be produced. Since the sound wave irradiation is incorporated in the steel sheet production process by the CAL 100, the CGL 200, or the CGL 300 (inline), the production efficiency is not impaired. Moreover, since hydrogen is desorbed not by heating but by sound wave irradiation, there is no concern that the mechanical properties of the steel sheet may be changed.

Figure 4:
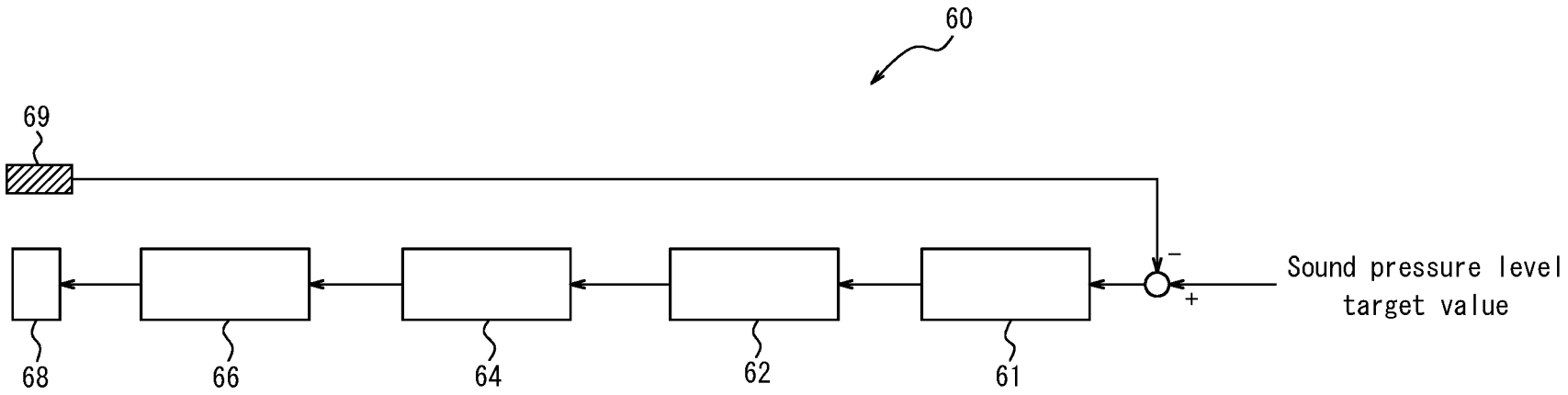
FIG. 4 is a schematic view illustrating the structure of a sound wave irradiator 60 used in each embodiment of the present disclosure.

Each embodiment of the present disclosure can be carried out by installing a typical sound wave irradiator (i.e. a sound wave generator) 60 as illustrated in FIG. 4 in the CAL 100, the CGL 200, or the CGL 300. The sound wave irradiation step can be carried out by irradiating the cold-rolled steel sheet S being passed with sound waves from the sound wave irradiator 60. The sound wave irradiator 60 includes a controller 61, a sound wave oscillator 62, a vibration transducer (speaker) 64, a booster (amplifier) 66, a horn 68, and a sound level meter 69. The sound wave oscillator 62 converts an electrical signal of a typical frequency (for example, 50 Hz or 60 $H_2$) into an electrical signal of a desired frequency, and transmits the electrical signal to the vibration transducer 64. While the voltage is typically AC 200 V to 240 V, it is amplified to nearly 1000 V in the sound wave oscillator 62. The electric signal of the desired frequency transmitted from the sound wave oscillator 62 is converted into mechanical vibration energy by a piezoelectric element in the vibration transducer 64, and the mechanical vibration energy is transmitted to the booster 66. The booster 66 amplifies the amplitude of the vibration energy transmitted from the vibration transducer 64 (or converts it into an optimum amplitude), and transmits the resultant vibration energy to the horn 68. The horn 68 is a member that imparts directivity to the vibration energy transmitted from the booster 66 and propagates it through the air as directional sound waves. The sound level meter 69 measures the sound pressure level of the sound waves emitted from the horn 68, with frequency weighting characteristic C. The controller 61 compares the output value of the sound level meter 69 with a set value, performs PID calculation or the like on the deviation to determine the current value of the vibration transducer 64 and the booster 66, and provides a command value to the sound wave oscillator 62 so as to achieve a predetermined frequency and sound pressure level.

Figure 5A:
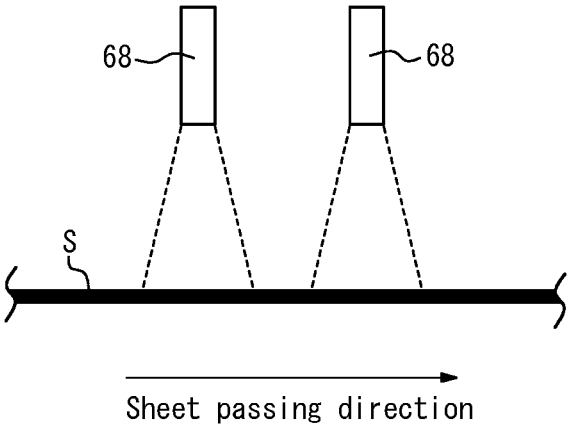
FIG. 5A is a side view schematically illustrating a first example of the positional relationship between a cold-rolled steel sheet S being passed and horns 68 of sound wave irradiators in each embodiment of the present disclosure.
Figure 5B:
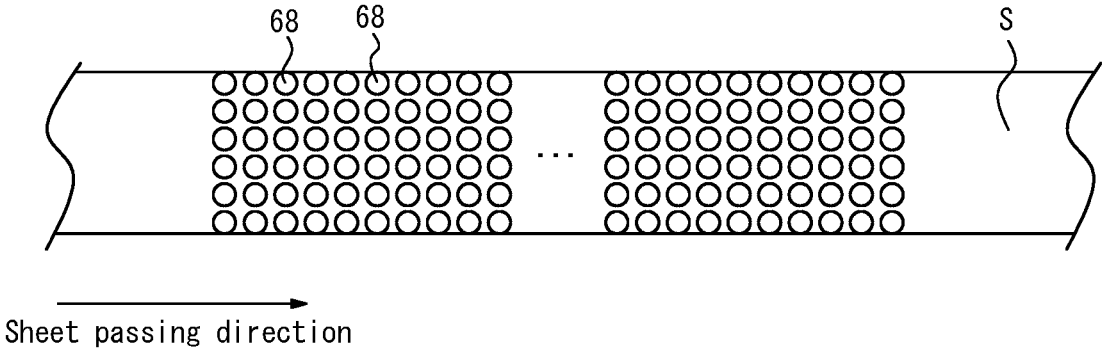
FIG. 5B is a top view schematically illustrating the first example.

As an example, the horn 68 may be a cylindrical member from the viewpoint of irradiating the cold-rolled steel sheet S with directional sound waves. As illustrated in FIGS. 5A and 5B, horns 68 of a plurality of sound wave irradiators 60 are arranged in the steel sheet transverse direction, with certain spacing from the main surface of the cold-rolled steel sheet S being passed. By irradiating the main surface of the cold-rolled steel sheet S being passed with sound waves from the horn 68 of each sound wave irradiator 60, the main surface can be uniformly irradiated with the sound waves in the transverse direction. As illustrated in FIG. 5A, the main traveling direction of the sound waves preferably coincides with the thickness direction of the cold-rolled steel sheet S. By arranging, in the sheet passing direction, a plurality of irradiator groups each of which is made up of a plurality of sound wave irradiators 60 arranged in the steel sheet transverse direction as illustrated in FIG. 5B, the surface of the cold-rolled steel sheet S can be exposed to sound waves for sufficient time.

Figure 5C:
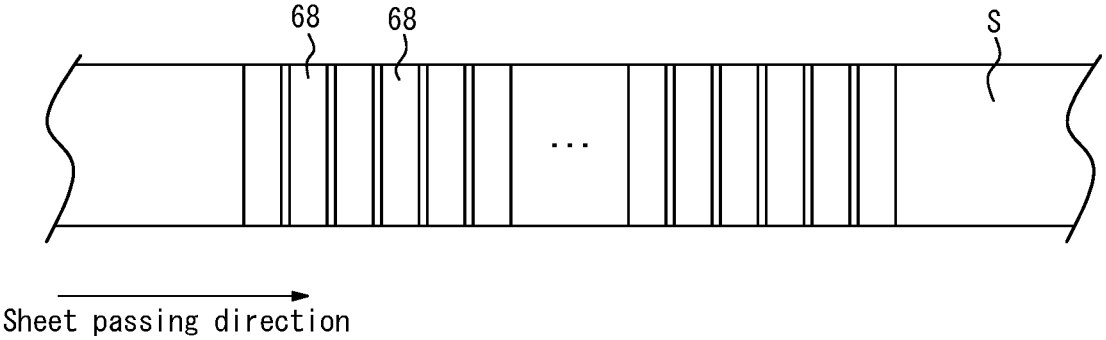
FIG. 5C is a top view schematically illustrating a second example of the positional relationship between a cold-rolled steel sheet S being passed and horns 68 of sound wave irradiators in each embodiment of the present disclosure.
Figure 6A:
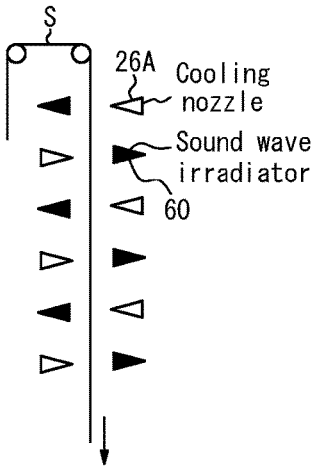
FIG. 6A is a schematic view illustrating an example of the positional relationship between cooling nozzles 26A and sound wave irradiators 60 in the case where the sound wave irradiators 60 are installed in a cooling zone 26.
Figure 6B:
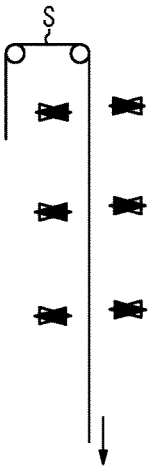
FIG. 6B is a schematic view illustrating an example of the positional relationship between cooling nozzles 26A and sound wave irradiators 60 in the case where the sound wave irradiators 60 are installed in a cooling zone 26.
Figure 6C:
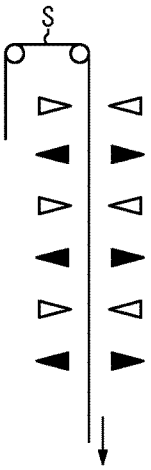
FIG. 6C is a schematic view illustrating an example of the positional relationship between cooling nozzles 26A and sound wave irradiators 60 in the case where the sound wave irradiators 60 are installed in a cooling zone 26.
Figure 6D:
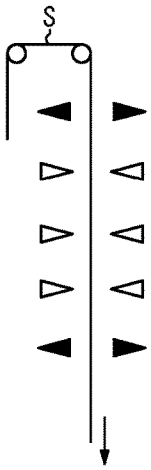
FIG. 6D is a schematic view illustrating an example of the positional relationship between cooling nozzles 26A and sound wave irradiators 60 in the case where the sound wave irradiators 60 are installed in a cooling zone 26.
Figure 6E:
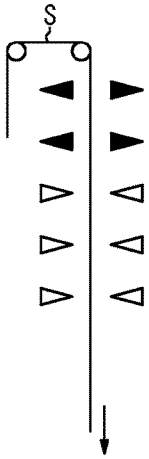
FIG. 6E is a schematic view illustrating an example of the positional relationship between cooling nozzles 26A and sound wave irradiators 60 in the case where the sound wave irradiators 60 are installed in a cooling zone 26.
Figure 6F:
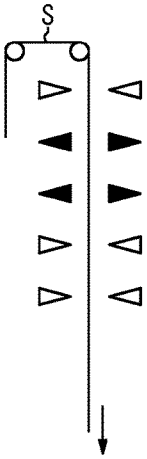
FIG. 6F is a schematic view illustrating an example of the positional relationship between cooling nozzles 26A and sound wave irradiators 60 in the case where the sound wave irradiators 60 are installed in a cooling zone 26.
Figure 6G:
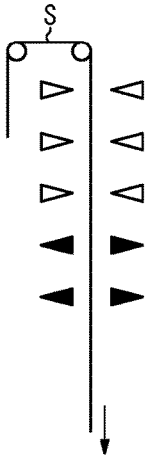
FIG. 6G is a schematic view illustrating an example of the positional relationship between cooling nozzles 26A and sound wave irradiators 60 in the case where the sound wave irradiators 60 are installed in a cooling zone 26.
Figure 6H:
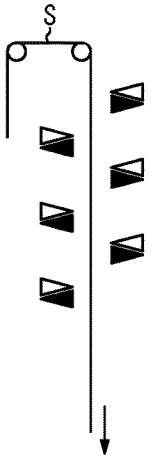
FIG. 6H is a schematic view illustrating an example of the positional relationship between cooling nozzles 26A and sound wave irradiators 60 in the case where the sound wave irradiators 60 are installed in a cooling zone 26.

As another example, the horn 68 may be a member having a rectangular opening whose longitudinal direction coincides with the transverse direction of the cold-rolled steel sheet S from the viewpoint of irradiating the cold-rolled steel sheet S with directional sound waves uniformly in the transverse direction, as illustrated in FIG. 5C. The horn 68 of the sound wave irradiator 60 is installed with certain spacing from the main surface of the cold-rolled steel sheet S being passed so that the opening will face the main surface. By irradiating the main surface of the cold-rolled steel sheet S being passed with sound waves from the horn 68 of the sound wave irradiator 60, the main surface can be uniformly irradiated with the sound waves in the transverse direction. The main traveling direction of the sound waves preferably coincides with the thickness direction of the cold-rolled steel sheet S. By arranging a plurality of sound wave irradiators 60 in the sheet passing direction as illustrated in FIG. 5C, the surface of the cold-rolled steel sheet S can be exposed to sound waves for sufficient time.

In Embodiments 1, 2, and 3, the position of the sound wave irradiator 60 is not limited as long as the cold-rolled steel sheet S being passed from the cooling zone 26 to the tension reel 50 can be irradiated with sound waves.

With reference to FIG. 1, examples of the preferred position of the sound wave irradiator 60, i.e. examples of the preferred timing of the sound wave irradiation step, in Embodiment 1 in which the CAL 100 produces a product coil of a cold-rolled and annealed steel sheet (CR) will be described below. As an example, the sound wave irradiator 60 can be provided in the cooling zone 26. In this case, the sound wave irradiation step can be performed in the step (B-2). Specifically, the irradiator group made up of the plurality of sound wave irradiators 60 arranged in the steel sheet transverse direction illustrated in FIGS. 5A and 5B or the sound wave irradiator 60 illustrated in FIG. 5C can be installed between the plurality of cooling zones arranged along the steel sheet conveyance path or between adjacent cooling nozzles arranged along the steel sheet conveyance path in each cooling zone. FIGS. 6A to 6H each illustrate an example of the positional relationship between cooling nozzles 26A and sound wave irradiators 60 in the case where the sound wave irradiators 60 are installed in the cooling zone 26. Here, the whole sound wave irradiator 60 need not be located inside the cooling zone 26 as long as at least the horn 68 is located inside the cooling zone 26.

As another example, the sound wave irradiator 60 can be provided at a position that enables irradiating the cold-rolled steel sheet S being passed through the downstream line 30 with sound waves. In this case, the sound wave irradiation step can be performed in the step (C). Specifically, the sound wave irradiator 60 can be provided in at least one of the following locations: (i) between the overaging treatment zone 28 and the exit looper 35, (ii) in the exit looper 35, (iii) between the exit looper 35 and the temper mill 36, and (iv) between the temper mill 36 and the tension reel 50.

The sound wave irradiator 60 may be provided both in the cooling zone 26 and at a position that enables irradiating the cold-rolled steel sheet S being passed through the downstream line 30 with sound waves. That is, the sound wave irradiation step may be performed in both the step (B-2) and the step (C). The sound wave irradiator 60 may be provided in the overaging treatment zone 28 to perform the sound wave irradiation step during the overaging treatment.

With reference to FIG. 2, examples of the preferred position of the sound wave irradiator 60, i.e. examples of the preferred timing of the sound wave irradiation step, in Embodiment 2 in which the CGL 200 produces a product of a galvannealed steel sheet (GA) will be described below. As an example, the sound wave irradiator 60 can be provided at a first position that enables irradiating the cold-rolled steel sheet S being passed upstream of the hot-dip galvanizing bath 31 with sound waves. In this case, the sound wave irradiation step can be performed before the step (C-1). Specifically, the sound wave irradiator 60 can be provided in the cooling zone 26. In detail, the irradiator group made up of the plurality of sound wave irradiators 60 arranged in the steel sheet transverse direction illustrated in FIGS. 5A and 5B or the sound wave irradiator 60 illustrated in FIG. 5C can be installed between the plurality of cooling zones arranged along the steel sheet conveyance path or between adjacent cooling nozzles arranged along the steel sheet conveyance path in each cooling zone. The examples illustrated in FIGS. 6A to 6H apply in this embodiment, too. Here, the whole sound wave irradiator 60 need not be located inside the cooling zone 26 as long as at least the horn 68 is located inside the cooling zone 26. At least the horn 68 of the sound wave irradiator 60 may be installed in the snout 29.

As another example, the sound wave irradiator 60 can be provided at a second position that enables irradiating the cold-rolled steel sheet S being passed downstream of the hot-dip galvanizing bath 31 with sound waves. In this case, the sound wave irradiation step can be performed after the step (C-1). Specifically, the sound wave irradiator 60 can be provided in at least one of the following locations: (i) between the hot-dip galvanizing bath 31 and the gas wiping device 32, (ii) between the gas wiping device 32 and the alloying furnace 33, (iii) in the alloying furnace 33, (iv) in the air cooling zone between the alloying furnace 33 and the cooling device 34, (v) between the cooling device 34 and the exit looper 35, (vi) in the exit looper 35, (vii) between the exit looper 35 and the temper mill 36, and (viii) between the temper mill 36 and the tension reel 50. It is particularly preferable to provide the sound wave irradiator 60 in the air cooling zone (iv).

The first position is more preferable than the second position as the position of the sound wave irradiator 60, from the viewpoint of desorbing hydrogen from inside the steel sheet more sufficiently. That is, it is more preferable to perform the sound wave irradiation step before the step (C-1) than after the step (C-1). The sound wave irradiator 60 may be provided at both the first position and the second position. That is, the sound wave irradiation step may be performed both before and after the step (C-1).

With reference to FIG. 3, examples of the preferred position of the sound wave irradiator 60, i.e. examples of the preferred timing of the sound wave irradiation step, in Embodiment 3 in which the CGL 300 produces a product of a hot-dip galvanized steel sheet (GI) will be described below. As an example, the sound wave irradiator 60 can be provided at a first position that enables irradiating the cold-rolled steel sheet being passed upstream of the hot-dip galvanizing bath 31 with sound waves. In this case, the sound wave irradiation step can be performed before the step (C-1). Specifically, the sound wave irradiator 60 can be provided in the cooling zone 26. In detail, the irradiator group made up of the plurality of sound wave irradiators 60 arranged in the steel sheet transverse direction illustrated in FIGS. 5A and 5B or the sound wave irradiator 60 illustrated in FIG. 5C can be installed between the plurality of cooling zones arranged along the steel sheet conveyance path or between adjacent cooling nozzles arranged along the steel sheet conveyance path in each cooling zone. The examples illustrated in FIGS. 6A to 6H apply in this embodiment, too. Here, the whole sound wave irradiator 60 need not be located inside the cooling zone 26 as long as at least the horn 68 is located inside the cooling zone 26. At least the horn 68 of the sound wave irradiator 60 may be installed in the snout 29.

As another example, the sound wave irradiator 60 can be provided at a second position that enables irradiating the cold-rolled steel sheet S being passed downstream of the hot-dip galvanizing bath 31 with sound waves. In this case, the sound wave irradiation step can be performed after the step (C-1). Specifically, the sound wave irradiator 60 can be provided in at least one of the following locations: (i) between the hot-dip galvanizing bath 31 and the gas wiping device 32, (ii) in the air cooling zone between the gas wiping device 32 and the cooling device 34, (iii) between the cooling device 34 and the exit looper 35, (iv) in the exit looper 35, (v) between the exit looper 35 and the temper mill 36, and (vi) between the temper mill 36 and the tension reel 50. It is particularly preferable to provide the sound wave irradiator 60 in the air cooling zone (ii).

The first position is more preferable than the second position as the position of the sound wave irradiator 60, from the viewpoint of desorbing hydrogen from inside the steel sheet more sufficiently. That is, it is more preferable to perform the sound wave irradiation step before the step (C-1) than after the step (C-1). The sound wave irradiator 60 may be provided at both the first position and the second position. That is, the sound wave irradiation step may be performed both before and after the step (C-1).

(Sound Pressure Level)

To reliably apply vibration to the cold-rolled steel sheet S and facilitate the diffusion of hydrogen, it is important that the sound pressure level at the surface of the cold-rolled steel sheet S in the sound wave irradiation step is 30 dB or more. The sound pressure level at the surface of the cold-rolled steel sheet S is preferably 60 dB or more, and more preferably 80 dB or more. The sound pressure level at the surface of the cold-rolled steel sheet S in the sound wave irradiation step is preferably 150 dB or less and more preferably 140 dB or less, in view of the performance of a typical sound wave irradiator. The sound pressure level at the surface of the cold-rolled steel sheet S can be adjusted by adjusting the intensity of the sound waves generated from the sound wave irradiator 60 and the position of the sound wave irradiator 60 (i.e. the distance between the sound wave irradiator 60 and the cold-rolled steel sheet S). The sound pressure level at the surface of the cold-rolled steel sheet S can be measured inline by installing a sound pressure meter near the surface of the cold-rolled steel sheet S being passed and directly below the sound wave irradiator 60. Alternatively, once the intensity I of the sound waves generated from the sound wave irradiator 60 and the distance D between the sound wave irradiator 60 and the cold-rolled steel sheet S have been determined, the sound pressure level at the surface of the cold-rolled steel sheet S can be measured offline. In detail, the sound pressure level at the surface of the cold-rolled steel sheet S can be measured by installing a sound pressure meter at a position of the distance D from an offline sound wave generator that generates sound waves of the intensity I in the main traveling direction of the sound waves.

(Sound Wave Frequency)

The frequency of the sound waves with which the cold-rolled steel sheet S is irradiated is preferably 10 Hz or more, more preferably 100 Hz or more, further preferably 500 Hz or more, and most preferably 1000 Hz or more, from the viewpoint of further facilitating the diffusion of hydrogen without the vibration being hindered due to the rigidity of the cold-rolled steel sheet S. The frequency of the sound waves with which the cold-rolled steel sheet S is irradiated is preferably 100000 Hz or less, more preferably 80000 Hz or less, and further preferably 50000 Hz or less, from the viewpoint of suppressing the attenuation of the sound waves in the air and applying sufficient vibration to the cold-rolled steel sheet S to facilitate the diffusion of hydrogen. The frequency of the sound waves emitted by the sound wave irradiator 60 can be controlled based on the current value applied to the vibration transducer 64.

(Sound Wave Irradiation Time)

The sound wave irradiation time for the cold-rolled steel sheet S in the sound wave irradiation step is preferably 1 second or more, more preferably 5 seconds or more, and further preferably 10 seconds or more, from the viewpoint of more sufficiently reducing hydrogen in the cold-rolled steel sheet S. The sound wave irradiation time for the cold-rolled steel sheet S is preferably 3600 seconds or less, more preferably 1800 seconds or less, and further preferably 900 seconds or less, from the viewpoint of hampering the productivity. Herein, the expression "sound wave irradiation time for the cold-rolled steel sheet S" denotes the time during which each position on the surface of the cold-rolled steel sheet S is exposed to sound waves. In the case where each position is exposed to sound waves from a plurality of sound wave irradiators 60, the term denotes the cumulative time. The irradiation time can be adjusted using the sheet passing speed of the cold-rolled steel sheet S and the position of the sound wave irradiator (for example, the number of irradiator groups arranged in the sheet passing direction where each irradiator group is made up of a plurality of sound wave irradiators 60 arranged in the steel sheet transverse direction as illustrated in FIGS. 5A and 5B, or the number of sound wave irradiators 60 arranged in the sheet passing direction as illustrated in FIG. 5C).

[Cold-Rolled Steel Sheet]

The cold-rolled steel sheet S supplied to each of the CAL 100, the CGL 200, and the CGL 300 according to the foregoing embodiments is not limited. The cold-rolled steel sheet S is preferably less than 6 mm in thickness. Examples of the cold-rolled steel sheet S include a high strength steel sheet having a tensile strength of 590 MPa or more and a stainless steel sheet.

[Chemical Composition of Cold-Rolled Steel Sheet: High Strength Steel Sheet]

The chemical composition in the case where the cold-rolled steel sheet S is a high strength steel sheet will be described below. In the following description, "mass %" is simply expressed as "%".

C: 0.030% to 0.800%

C has an effect of increasing the strength of the steel sheet. From the viewpoint of achieving this effect, the C content is 0.030% or more, and preferably 0.080% or more. If the C content is excessively high, the steel sheet embrittles significantly irrespective of the hydrogen content in the steel sheet. The C content is therefore 0.800% or less, and preferably 0.500% or less.

Si: 0.01% to 3.00%

Si has an effect of increasing the strength of the steel sheet. From the viewpoint of achieving this effect, the Si content is 0.01% or more, and preferably 0.10% or more. If the Si content is excessively high, the steel sheet embrittles, causing a decrease in ductility. Moreover, red scale and the like form, as a result of which the surface characteristics degrade and the coating quality decreases. The Si content is therefore 3.00% or less, and preferably 2.50% or less.

Mn: 0.01% to 10.00%

Mn has an effect of increasing the strength of the steel sheet by solid solution strengthening. From the viewpoint of achieving this effect, the Mn content is 0.01% or more, and preferably 0.5% or more. If the Mn content is excessively high, the steel microstructure tends to be not uniform due to segregation of Mn, and hydrogen embrittlement originating from such nonuniformity may emerge. The Mn content is therefore 10.00% or less, and preferably 8.00% or less.

P: 0.001% to 0.100%

P is an element that has a solid solution strengthening action and can be added depending on the desired strength. From the viewpoint of achieving this effect, the P content is 0.001% or more, and preferably 0.003% or more. If the P content is excessively high, the weldability degrades. In the case of alloying the galvanizing, the alloying rate decreases and the galvanizing quality is impaired. The P content is therefore 0.100% or less, and preferably 0.050% or less.

S: 0.0001% to 0.0200%

S segregates to grain boundaries and embrittles the steel in hot working, and also exists as sulfide and causes a decrease in local deformability. The S content is therefore 0.0200% or less, preferably 0.0100% or less, and more preferably 0.0050% or less. The S content is 0.0001% or more under manufacturing constraints.

N: 0.0005% to 0.0100%

N is an element that degrades the aging resistance of the steel. The N content is therefore 0.0100% or less, and preferably 0.0070% or less. The N content is desirably as low as possible. Under manufacturing constraints, however, the N content is 0.0005% or more, and preferably 0.0010% or more.

Al: 0.001% to 2.000%

Al is an element that acts as a deoxidizer and is effective for the cleanliness of the steel. From the viewpoint of achieving this effect, the Al content is 0.001% or more, and preferably 0.010% or more. If the Al content is excessively high, slab cracking is likely to occur in continuous casting. The Al content is therefore 2.000% or less, and preferably 1.200% or less.

The balance other than the components described above is Fe and inevitable impurities. The chemical composition may optionally further contain at least one element selected from the following.

Ti: 0.200% or Less

Ti contributes to higher strength of the steel sheet by strengthening the steel by precipitation or by grain refinement strengthening through growth inhibition of ferrite crystal grains. Accordingly, in the case of adding Ti, the Ti content is preferably 0.005% or more, and more preferably 0.010% or more. If the Ti content is excessively high, carbonitride precipitates in a large amount, as a result of which the formability may decrease. Accordingly, in the case of adding Ti, the Ti content is 0.200% or less, and preferably 0.100% or less.

Nb: 0.200% or Less, V: 0.500% or Less, W: 0.500% or Less

Nb, V, and W are effective in strengthening the steel by precipitation. Accordingly, in the case of adding Nb, V, and W, the content of each element is preferably 0.005% or more, and more preferably 0.010% or more. If the content of each element is excessively high, carbonitride precipitates in a large amount, as a result of which the formability may decrease. Accordingly, in the case of adding Nb, the Nb content is 0.200% or less, and preferably 0.100% or less. In the case of adding V and W, the content of each element is 0.500% or less, and preferably 0.300% or less.

B: 0.0050% or Less

B is effective in strengthening grain boundaries and strengthening the steel sheet. Accordingly, in the case of adding B, the B content is preferably 0.0003% or more. If the B content is excessively high, the formability may decrease. Accordingly, in the case of adding B, the B content is 0.0050% or less, and preferably 0.0030% or less.

Ni: 1.000% or Less

Ni is an element that increases the strength of the steel by solid solution strengthening. Accordingly, in the case of adding Ni, the Ni content is preferably 0.005% or more. If the Ni content is excessively high, the area ratio of hard martensite is excessively high. In a tensile test, microvoids at the crystal grain boundaries of martensite increase and crack propagation progresses, as a result of which the ductility may decrease. Accordingly, in the case of adding Ni, the Ni content is 1.000% or less.

Cr: 1.000% or Less, Mo: 1.000% or Less

Cr and Mo have an action of improving the balance between the strength and the formability. Accordingly, in the case of adding Cr and Mo, the content of each element is preferably 0.005% or more. If the content of each element is excessively high, the area ratio of hard martensite is excessively high. In a tensile test, microvoids at the crystal grain boundaries of martensite increase and crack propagation progresses, as a result of which the ductility may decrease. Accordingly, in the case of adding Cr and Mo, the content of each element is 1.000% or less.

Cu: 1.000% or Less

Cu is an element effective in strengthening the steel. Accordingly, in the case of adding Cu, the Cu content is preferably 0.005% or more. If the Cu content is excessively high, the area ratio of hard martensite is excessively high. In a tensile test, microvoids at the crystal grain boundaries of tempered martensite increase and crack propagation progresses, as a result of which the ductility may decrease. Accordingly, in the case of adding Cu, the Cu content is 1.000% or less.

Sn: 0.200% or Less, Sb: 0.200% or Less

Sn and Sb are effective in suppressing decarburization of regions of about several tens of μm of the steel sheet surface layer caused by nitridization or oxidation of the steel sheet surface and ensuring the strength and the material stability. Accordingly, in the case of adding Sn and Sb, the content of each element is preferably 0.002% or more. If the content of each element is excessively high, the toughness may decrease. Accordingly, in the case of adding Sn and Sb, the content of each element is 0.200% or less.

Ta: 0.100% or Less

Ta forms alloy carbide or alloy carbonitride and contributes to higher strength, as with Ti and Nb. Ta is also considered to have an effect of, by partially dissolving in Nb carbide or Nb carbonitride and forming composite precipitate such as (Nb, Ta)(C, N), significantly suppressing the coarsening of precipitate and stabilizing the contribution of precipitation to higher strength. Accordingly, in the case of adding Ta, the Ta content is preferably 0.001% or more. If the Ta content is excessively high, the precipitate stabilizing effect is likely to be saturated, and also the alloy costs increase. Accordingly, in the case of adding Ta, the Ta content is 0.100% or less.

Ca: 0.0050% or Less, Mg: 0.0050% or Less, Zr: 0.1000% or Less, REM (Rare Earth Metal): 0.0050% or Less Ca, Mg, Zr, and REM are elements effective for spheroidizing sulfide and improving the adverse effect of the sulfide on the formability. In the case of adding these elements, the content of each element is preferably 0.0005% or more. If the content of each element is excessively high, inclusions and the like increase, as a result of which surface and internal defects may occur. Accordingly, in the case of adding these elements, the content of each element is 0.0050% or less.

[Chemical Composition of Cold-Rolled Steel Sheet: Stainless Steel Sheet]

The chemical composition in the case where the cold-rolled steel sheet S is a stainless steel sheet will be described below. In the following description, "mass %" is simply expressed as "%".

C: 0.001% to 0.400%

C is an element essential for achieving high strength in the stainless steel. However, C combines with Cr and precipitates as carbide during tempering in steel production, which causes degradation in the corrosion resistance and toughness of the steel. If the C content is less than 0.001%, sufficient strength cannot be obtained. If the C content is more than 0.400%, the degradation is significant. The C content is therefore 0.001% to 0.400%.

Si: 0.01% to 2.00%

Si is an element useful as a deoxidizer. From the viewpoint of achieving this effect, the Si content is 0.01% or more. If the Si content is excessively high, Si dissolved in the steel decreases the workability of the steel. The Si content is therefore 2.00% or less.

Mn: 0.01% to 5.00%

Mn has an effect of increasing the strength of the steel. From the viewpoint of achieving this effect, the Mn content is 0.01% or more. If the Mn content is excessively high, the workability of the steel decreases. The Mn content is therefore 5.00% or less.

P: 0.001% to 0.100%

P is an element that promotes grain boundary fractures due to grain boundary segregation. Accordingly, the P content is desirably as low as possible. The P content is 0.100% or less, preferably 0.030% or less, and more preferably 0.020% or less. The P content is 0.001 or more under manufacturing constraints.

S: 0.0001% to 0.0200%

S exists as a sulfide-based inclusion such as MnS and causes decreases in ductility, corrosion resistance, and the like. Accordingly, the S content is desirably as low as possible. The S content is 0.0200 or less, preferably 0.0100% or less, and more preferably 0.0050% or less. The S content is 0.0001% or more under manufacturing constraints.

Cr: 9.0% to 28.0%

Cr is a basic element constituting stainless steel, and is an important element that develops the corrosion resistance. Considering the corrosion resistance in a harsh environment of 180° C. or more, if the Cr content is less than 9.0%, the corrosion resistance is insufficient, and if the Cr content is more than 28.0%, the effect is saturated and the economic efficiency is poor. The Cr content is therefore 9.0% to 28.0%.

Ni: 0.01% to 40.0%

Ni is an element that improves the corrosion resistance of the stainless steel. If the Ni content is less than 0.01%, the effect is insufficient. If the Ni content is excessively high, the formability degrades, and stress corrosion cracking tends to occur. The Ni content is therefore 0.01% to 40.0%.

N: 0.0005% to 0.500%

N is an element detrimental to improving the corrosion resistance of the stainless steel. The N content is therefore 0.500% or less, and preferably 0.200% or less. The N content is desirably as low as possible, but is 0.0005% or more under manufacturing constraints.

Al: 0.001% to 3.000%

Al acts as a deoxidizer, and also has an effect of suppressing exfoliation of oxide scale. From the viewpoint of achieving these effects, the Al content is 0.001% or more. If the Al content is excessively high, the elongation decreases and the surface quality degrades. The Al content is therefore 3.000% or less.

The balance other than the components described above is Fe and inevitable impurities. The chemical composition may optionally further contain at least one element selected from the following.

Ti: 0.500% or Less

Ti combines with C, N, and S and improves the corrosion resistance, the intergranular corrosion resistance, and the deep drawability. If the Ti content is more than 0.500%, solute Ti degrades the toughness. Accordingly, in the case of adding Ti, the Ti content is 0.500% or less.

Nb: 0.500% or Less

Nb combines with C, N, and S and improves the corrosion resistance, the intergranular corrosion resistance, and the deep drawability, as with Ti. Nb also improves the workability and the high-temperature strength, and suppresses crevice corrosion and facilitates repassivation. If the Nb content is excessively high, however, the formability degrades due to hardening. Accordingly, in the case of adding Nb, the Nb content is 0.500% or less.

V: 0.500% or Less

V suppresses crevice corrosion. If the V content is excessively high, however, the formability degrades. Accordingly, in the case of adding V, the V content is 0.500% or less.

W: 2.000% or Less

W contributes to improved corrosion resistance and high-temperature strength. If the W content is excessively high, however, the toughness degrades in steel sheet production, and the costs increase. Accordingly, in the case of adding W, the W content is 2.000% or less.

B: 0.0050% or Less

B segregates to grain boundaries to improve the secondary workability of the product. If the B content is excessively high, however, the workability and the corrosion resistance decrease. Accordingly, in the case of adding B, the B content is 0.0050% or less.

Mo: 2.000% or Less

Mo is an element that improves the corrosion resistance and in particular suppresses crevice corrosion. If the Mo content is excessively high, however, the formability degrades. Accordingly, in the case of adding Mo, the Mo content is 2.000% or less.

Cu: 3.000% or Less

Cu is an austenite stabilizing element as with Ni and Mn, and is effective in crystal grain refinement by phase transformation. Cu also suppresses crevice corrosion and facilitates repassivation. If the Cu content is excessively high, however, the toughness and the formability degrade. Accordingly, in the case of adding Cu, the Cu content is 3.000% or less.

Sn: 0.500% or Less

Sn contributes to improved corrosion resistance and high-temperature strength. If the Sn content is excessively high, however, slab cracking is likely to occur in steel sheet production. Accordingly, in the case of adding Sn, the Sn content is 0.500% or less.

Sb: 0.200% or Less

Sb has an action of segregating to grain boundaries and increasing the high-temperature strength. If the Sb content is excessively high, however, cracking is likely to occur in welding due to Sb segregation. Accordingly, in the case of adding Sb, the Sb content is 0.200% or less.

Ta: 0.100% or Less

Ta combines with C and N and contributes to improved toughness. If the Ta content is excessively high, however, the effect is saturated, and the production costs increase. Accordingly, in the case of adding Ta, the Ta content is 0.100% or less.

Ca: 0.0050% or Less, Mg: 0.0050% or Less, Zr: 0.1000% or Less, REM (Rare Earth Metal): 0.0050% or Less Ca, Mg, Zr, and REM are elements effective for spheroidizing sulfide and improving the adverse effect of the sulfide on the formability. In the case of adding these elements, the content of each element is preferably 0.0005% or more. If the content of each element is excessively high, inclusions and the like increase, as a result of which surface and internal defects may occur. Accordingly, in the case of adding these elements, the content of each element is 0.0050% or less.

[Diffusible Hydrogen Content]

In this embodiment, the diffusible hydrogen content in the product coil is preferably 0.50 mass ppm or less, more preferably 0.30 mass ppm or less, and further preferably 0.20 mass ppm or less, in order to ensure favorable bendability. Although no lower limit is placed on the diffusible hydrogen content in the product coil, the diffusible hydrogen content in the product coil may be 0.01 mass ppm or more under manufacturing constraints.

The method of measuring the diffusible hydrogen content in the product coil is as follows: A test piece of 30 mm in length and 5 mm in width is collected from the product coil. In the case of a product coil of a hot-dip galvanized steel sheet or a galvannealed steel sheet, the hot-dip galvanized layer or the galvannealed layer of the test piece is removed by grinding or alkali. After this, the amount of hydrogen released from the test piece is measured by thermal desorption spectrometry (TDS). Specifically, the test piece is continuously heated from room temperature to 300° C. at a heating rate of 200° C./h and then cooled to room temperature, and the cumulative amount of hydrogen released from the test piece from room temperature to 210° C. is measured and taken to be the diffusible hydrogen content in the product coil.

EXAMPLES

First Example

Steels each having a chemical composition containing C: 0.21%, Si: 1.5%, Mn: 2.7%, P: 0.02%, S: 0.002%, Al: 0.03%, and N: 0.003% with the balance being Fe and inevitable impurities were each obtained by steelmaking using a converter, and continuously cast into a slab. The obtained slab was subjected to hot rolling and cold rolling to obtain a cold-rolled coil. As shown in Table 1, a product coil of a cold-rolled and annealed steel sheet (CR) was produced by the CAL illustrated in FIG. 1 in some examples, a product coil of a hot-dip galvanized steel sheet (GI) was produced without heating and alloying by the CGL illustrated in FIG. 2 in some other examples, and a product coil of a galvannealed steel sheet (GA) was produced by the CGL illustrated in FIG. 2 in the remaining examples.

For each of the Examples and the Comparative Examples, the cold-rolled steel sheet being passed was irradiated with sound waves using the typical sound wave irradiator illustrated in FIG. 4, under the conditions of the sound pressure level, the frequency, and the irradiation time shown in Table 1. In Table 1, "sound wave irradiation location" indicates the region in the CAL or the CGL where the sound wave irradiation step was performed, i.e. the installation location of the sound wave irradiator.

"(B-2)" denotes that the sound wave irradiator was installed in the cooling zone in the CAL or the CGL and the sound wave irradiation step was performed in the cooling zone of the step (B-2).

"(C)" denotes that the sound wave irradiator was installed at a position that enables irradiating the cold-rolled steel sheet being passed through the downstream line with sound waves in the CAL, that is, the sound wave irradiator was installed at a position downstream of the cooling zone and upstream of the tension reel, specifically, at least one location out of (i) between the overaging treatment zone 28 and the exit looper 35, (ii) in the exit looper 35, (iii) between the exit looper 35 and the temper mill 36, and (iv) between the temper mill 36 and the tension reel 50, and the sound wave irradiation step was performed in the step (C), specifically, in at least one location out of the foregoing (i) to (iv).

"Before (C-1)" denotes that the sound wave irradiator was installed at a position downstream of the cooling zone and upstream of the hot-dip galvanizing bath in the CGL, specifically, in the snout 29, and the sound wave irradiation step was performed after the step (B-2) and before the step (C-1).

"After (C-1)" denotes that the sound wave irradiator was installed at a position downstream of the hot-dip galvanizing bath and upstream of the tension reel in the CGL, specifically, at least one location out of (i) between the hot-dip galvanizing bath 31 and the gas wiping device 32, (ii) between the gas wiping device 32 and the alloying furnace 33, (iii) in the alloying furnace 33, (iv) in the air cooling zone between the alloying furnace 33 and the cooling device 34, (v) between the cooling device 34 and the exit looper 35, (vi) in the exit looper 35, (vii) between the exit looper 35 and the temper mill 36, and (viii) between the temper mill 36 and the tension reel 50, and the sound wave irradiation step was performed after the step (C-1), specifically, in at least one location out of the foregoing (i) to (viii).

The product coil obtained in each example was submitted to the following evaluation. The results are shown in Table 1.

[Measurement of Hydrogen Content in Steel Sheet]

The diffusible hydrogen content in the product coil was measured by the above-described method.

[Measurement of Tensile Strength TS]

A tensile test was conducted in accordance with JIS Z 2241. A JIS No. 5 test piece was collected from the obtained product coil so that the longitudinal direction of the test piece would be perpendicular to the rolling direction of the steel sheet. Using the test piece, the tensile test was conducted under the conditions of a crosshead displacement rate of $1.67\times10^{-1}$ mm/s, and TS was measured.

[Evaluation of Stretch Flangeability]

The stretch flangeability was evaluated by a hole expanding test. The hole expanding test was conducted in accordance with JIS Z 2256. A sample of 100 mm×100 mm was collected from the obtained product coil by shearing. A hole with a diameter of 10 mm was drilled through the sample with clearance 12.5%. In a state in which the periphery of the hole was clamped using a die having an inner diameter of 75 mm with a blank holding force of 9 tons (88.26 kN), a conical punch with an apical angle of 60° was pushed into the hole, and the hole diameter at crack initiation limit was measured. The maximum hole expansion ratio λ (%) was calculated using the following equation, and the hole expansion formability was evaluated from the maximum hole expansion ratio.

$$\text{Maximum hole expansion ratio: } \lambda(\%)=\{(D_f-D_0)/D_0\}\times100$$

where $D_f$ is the hole diameter at the time of occurrence of cracking (mm), and $D_0$ is the initial hole diameter (mm). In the case where the value of λ was 20% or more, the stretch flangeability was determined as favorable.

[Evaluation of Bendability]

A bend test was conducted in accordance with JIS Z 2248. A strip test piece of 30 mm in width and 100 mm in length was collected from the obtained product coil so that the axial direction of the bend test would be parallel to the rolling direction of the steel sheet. The bend test was then conducted by a V-block bend test with a bending angle of 90°, under the conditions of an indentation load of 100 kN and a pressing-holding time of 5 seconds. In the present disclosure, a 90° V bend test was conducted, the ridge line part of the bending apex was observed with a microscope (RH-2000 produced by HIROX Co., Ltd.) with 40 magnification, and the bending radius when cracks of 200 μm or more in crack length were no longer observed was taken to be the minimum bending radius (R). In the case where the value (R/t) obtained by dividing R by the thickness (t) was 5.0 or less, the result of the bend test was determined as favorable.

In each Example, the sound wave irradiation step was performed, so that a steel sheet having low hydrogen content and excellent in stretch flangeability (λ) and bendability (R/t) as indexes of hydrogen embrittlement resistance was able to be produced.

TABLE 1

| | | Sound wave irradiation conditions | | | | Steel sheet | | | | | |
|---|---|---|---|---|---|---|---|---|---|---|---|
| No. | Line | Sound wave irradiation location | Sound pressure level (dB) | Frequency (Hz) | Irradiation time (sec) | Product coil [1)] | Diffusible hydrogen content (mass ppm) | TS (MPa) | λ (%) | R/t | Category |
| 1 | CAL | (C) | 100 | 1000 | 10 | CR | 0.20 | 1480 | 40 | 2.5 | Example |
| 2 | CAL | (B-2) + (C) | 100 | 1000 | 10 | CR | 0.10 | 1480 | 45 | 2.0 | Example |
| 3 | CAL | (B-2) | 100 | 1000 | 10 | CR | 0.15 | 1480 | 42 | 2.3 | Example |
| 4 | CAL | — | — | — | — | CR | 0.55 | 1480 | 17 | 5.5 | Comparative Example |

TABLE 1-continued

| | | Sound wave irradiation conditions | | | | Steel sheet | | | | | |
|---|---|---|---|---|---|---|---|---|---|---|---|
| No. | Line | Sound wave irradiation location | Sound pressure level (dB) | Frequency (Hz) | Irradiation time (sec) | Product coil [1)] | Diffusible hydrogen content (mass ppm) | TS (MPa) | λ (%) | R/t | Category |
| 5 | CGL | (B-2) + before (C-1) | 100 | 1000 | 10 | GA | 0.25 | 1480 | 38 | 2.5 | Example |
| 6 | CGL | (B-2) + after (C-1) | 100 | 1000 | 10 | GA | 0.30 | 1480 | 35 | 3.0 | Example |
| 7 | CGL | (B-2) + before (C-1) + after (C-1) | 100 | 1000 | 10 | GA | 0.20 | 1480 | 40 | 2.1 | Example |
| 8 | CGL | (B-2) + before (C-1) + after (C-1) | 100 | 1000 | 10 | GI | 0.30 | 1480 | 37 | 3.3 | Example |
| 9 | CGL | after (C-1) | 100 | 1000 | 10 | GA | 0.45 | 1480 | 23 | 4.7 | Example |
| 10 | CGL | after (C-1) | 100 | 1000 | 10 | GI | 0.50 | 1480 | 20 | 5.0 | Example |
| 11 | CGL | (B-2) | 100 | 1000 | 10 | GA | 0.35 | 1480 | 30 | 4.0 | Example |
| 12 | CGL | before (C-1) | 100 | 1000 | 10 | GA | 0.40 | 1480 | 25 | 4.5 | Example |
| 13 | CGL | before (C-1) + after (C-1) | 100 | 1000 | 10 | GA | 0.37 | 1480 | 27 | 4.3 | Example |
| 14 | CGL | — | — | — | — | GA | 0.70 | 1480 | 9 | 7.5 | Comparative Example |

Underlines indicate outside the range according to the present disclosure.

[1)] CR: cold-rolled steel sheet, GI: hot-dip galvanized steel sheet (without alloying treatment of galvanizing), GA: galvannealed steel sheet

Second Example

Steels each having a chemical composition containing the elements shown in Table 2 with the balance being Fe and inevitable impurities were each obtained by steelmaking using a converter, and continuously cast into a slab. The obtained slab was subjected to hot rolling and cold rolling to obtain a cold-rolled coil. As shown in Table 3, a product coil of a cold-rolled and annealed steel sheet (CR) was produced by the CAL illustrated in FIG. 1 in some example, a product coil of a hot-dip galvanized steel sheet (GI) was produced without heating and alloying by the CGL illustrated in FIG. 2 in some other examples, and a product coil of a galvannealed steel sheet (GA) was produced by the CGL illustrated in FIG. 2 in the remaining examples.

For each of the Examples and the Comparative Examples, the cold-rolled steel sheet being passed was irradiated with sound waves using the typical sound wave irradiator illustrated in FIG. 4, under the conditions of the sound pressure level, the frequency, and the irradiation time shown in Table 3. In Table 3, "sound wave irradiation location" indicates the region in the CAL or the CGL where the sound wave irradiation step was performed, i.e. the installation location of the sound wave irradiator.

"(B-2)" denotes that the sound wave irradiator was installed in the cooling zone in the CAL or the CGL and the sound wave irradiation step was performed in the cooling zone of the step (B-2).

"(C)" denotes that the sound wave irradiator was installed at a position that enables irradiating the cold-rolled steel sheet being passed through the downstream line with sound waves in the CAL, that is, the sound wave irradiator was installed at a position downstream of the cooling zone and upstream of the tension reel, specifically, at least one location out of (i) between the overaging treatment zone 28 and the exit looper 35, (ii) in the exit looper 35, (iii) between the exit looper 35 and the temper mill 36, and (iv) between the temper mill 36 and the tension reel 50, and the sound wave irradiation step was performed in the step (C), specifically, in at least one location out of the foregoing (i) to (iv).

"Before (C-1)" denotes that the sound wave irradiator was installed at a position downstream of the cooling zone and upstream of the hot-dip galvanizing bath in the CGL, specifically, in the snout 29, and the sound wave irradiation step was performed after the step (B-2) and before the step (C-1).

"After (C-1)" denotes that the sound wave irradiator was installed at a position downstream of the hot-dip galvanizing bath and upstream of the tension reel in the CGL, specifically, at least one location out of (i) between the hot-dip galvanizing bath 31 and the gas wiping device 32, (ii) between the gas wiping device 32 and the alloying furnace 33, (iii) in the alloying furnace 33, (iv) in the air cooling zone between the alloying furnace 33 and the cooling device 34, (v) between the cooling device 34 and the exit looper 35, (vi) in the exit looper 35, (vii) between the exit looper 35 and the temper mill 36, and (viii) between the temper mill 36 and the tension reel 50, and the sound wave irradiation step was performed after the step (C-1), specifically, in at least one location out of the foregoing (i) to (viii).

A steel sheet sample was collected form the product coil obtained in each example, and the tensile property and the hydrogen embrittlement resistance were evaluated as follows. The results are shown in Table 3.

A tensile test was conducted in accordance with JIS Z 2241 (2011) using a JIS No. 5 test piece collected so that the tensile direction would be perpendicular to the rolling direction of the steel sheet, and the tensile strength (TS) and the total elongation (EL) were measured.

The hydrogen embrittlement resistance was evaluated from the foregoing tensile test as follows: In the case where the value obtained by dividing EL in the steel sheet after the sound wave irradiation measured in the foregoing test by EL' when the hydrogen content in the steel of the same steel sheet was 0.00 mass ppm was 0.70 or more, the hydrogen embrittlement resistance was determined as favorable. Here, EL' was measured by leaving the same steel sheet in the air for a long time to reduce hydrogen in the steel and, after determining that the hydrogen content in the steel had reached 0.00 mass ppm by TDS, conducting a tensile test.

The diffusible hydrogen content in the product coil obtained in each example was measured by the method described above. The results are shown in Table 3.

In each Example, the sound wave irradiation step was performed, so that a steel sheet excellent in hydrogen embrittlement resistance was able to be produced.

TABLE 2

| Steel sample | Chemical composition (mass %) | | | | | | | | | | | | |
|---|---|---|---|---|---|---|---|---|---|---|---|---|---|
| ID | C | Si | Mn | P | S | N | Al | Ti | Nb | V | W | B | Ni |
| A | 0.212 | 1.45 | 2.72 | 0.021 | 0.0022 | 0.0034 | 0.030 | — | — | — | — | — | — |
| B | 0.184 | 1.51 | 2.25 | 0.026 | 0.0025 | 0.0041 | 0.047 | — | — | — | — | — | — |
| C | 0.165 | 0.55 | 3.54 | 0.019 | 0.0019 | 0.0021 | 0.034 | 0.052 | — | — | — | — | — |
| D | 0.785 | 0.98 | 1.30 | 0.029 | 0.0029 | 0.0025 | 0.058 | — | — | — | — | — | — |
| E | 0.048 | 1.00 | 3.10 | 0.031 | 0.0024 | 0.0026 | 0.031 | — | — | — | — | — | — |
| F | 0.180 | 2.90 | 3.21 | 0.027 | 0.0019 | 0.0026 | 0.031 | 0.044 | — | — | — | — | — |
| G | 0.423 | 0.60 | 1.11 | 0.031 | 0.0020 | 0.0035 | 0.041 | — | — | — | — | — | — |
| H | 0.081 | 1.01 | 5.01 | 0.026 | 0.0027 | 0.0031 | 0.045 | — | — | — | — | — | — |
| I | 0.231 | 2.02 | 2.85 | 0.020 | 0.0022 | 0.0025 | 0.035 | — | — | — | — | — | — |
| J | 0.159 | 0.20 | 3.44 | 0.029 | 0.0023 | 0.0037 | 0.031 | 0.045 | — | — | — | — | — |
| K | 0.125 | 0.35 | 6.99 | 0.025 | 0.0026 | 0.0032 | 0.030 | 0.051 | — | — | — | — | — |
| L | 0.348 | 0.45 | 0.62 | 0.022 | 0.0026 | 0.0028 | 0.034 | — | — | — | — | — | — |
| M | 0.175 | 0.34 | 1.88 | 0.020 | 0.0028 | 0.0030 | 1.052 | 0.043 | — | — | — | — | — |
| N | 0.180 | 0.328 | 1.82 | 0.026 | 0.0027 | 0.0042 | 0.046 | — | — | — | — | — | — |
| O | 0.140 | 0.73 | 3.42 | 0.020 | 0.0024 | 0.0039 | 0.040 | — | 0.051 | — | — | — | — |
| P | 0.120 | 0.51 | 2.53 | 0.029 | 0.0025 | 0.0040 | 0.045 | 0.020 | 0.040 | — | — | — | — |
| Q | 0.120 | 1.12 | 2.52 | 0.031 | 0.0024 | 0.0027 | 0.045 | 0.089 | — | 0.060 | — | — | — |
| R | 0.101 | 1.19 | 4.07 | 0.027 | 0.0027 | 0.0032 | 0.044 | — | — | — | 0.020 | — | — |
| S | 0.262 | 0.91 | 3.00 | 0.031 | 0.0022 | 0.0044 | 0.040 | 0.020 | — | — | — | 0.0021 | — |
| T | 0.189 | 0.68 | 6.39 | 0.026 | 0.0023 | 0.0040 | 0.014 | 0.195 | — | — | — | — | 0.125 |
| U | 0.088 | 0.15 | 2.30 | 0.020 | 0.0026 | 0.0037 | 0.058 | — | — | — | — | — | — |
| V | 0.100 | 1.42 | 3.08 | 0.029 | 0.0026 | 0.0032 | 0.032 | 0.024 | — | — | — | — | — |
| W | 0.174 | 1.52 | 2.74 | 0.025 | 0.0025 | 0.0027 | 0.040 | — | — | — | — | — | — |
| X | 0.119 | 0.56 | 3.17 | 0.025 | 0.0020 | 0.0033 | 0.035 | 0.035 | — | — | — | — | — |
| Y | 0.160 | 0.43 | 1.99 | 0.020 | 0.0021 | 0.0026 | 0.033 | 0.091 | — | — | — | — | — |
| Z | 0.133 | 0.69 | 3.58 | 0.018 | 0.0019 | 0.0030 | 0.030 | — | — | — | — | — | — |
| AA | 0.240 | 1.52 | 2.74 | 0.024 | 0.0025 | 0.0040 | 0.040 | — | — | — | — | — | — |
| AB | 0.182 | 0.95 | 2.81 | 0.022 | 0.0024 | 0.0036 | 0.035 | — | — | — | — | — | — |
| AC | 0.123 | 0.03 | 3.01 | 0.026 | 0.0023 | 0.0028 | 0.040 | 0.008 | — | — | — | — | — |
| AD | 0.079 | 0.05 | 7.12 | 0.021 | 0.0028 | 0.0036 | 0.041 | — | — | — | — | — | — |
| AE | 0.061 | 0.62 | 1.09 | 0.030 | 0.0078 | 0.0360 | 0.033 | — | — | — | — | — | 8.15 |
| AF | 0.059 | 0.68 | 0.92 | 0.028 | 0.0064 | 0.0312 | 0.035 | — | — | — | — | — | 0.21 |
| AG | 0.102 | 0.76 | 0.89 | 0.024 | 0.0068 | 0.0324 | 0.038 | — | — | — | — | — | 0.15 |
| AH | 0.021 | 0.61 | 0.92 | 0.030 | 0.0150 | 0.0200 | 0.042 | 0.388 | — | — | — | — | 0.12 |
| AI | 0.019 | 0.77 | 0.89 | 0.028 | 0.0152 | 0.0195 | 0.038 | 0.378 | — | — | — | — | 0.16 |
| AJ | 0.024 | 0.83 | 0.91 | 0.024 | 0.0136 | 0.0222 | 0.034 | 0.390 | 0.467 | — | — | — | 0.22 |

| Steel sample | Chemical composition (mass %) | | | | | | | | | | |
|---|---|---|---|---|---|---|---|---|---|---|---|
| ID | Cr | Mo | Cu | Sn | Sb | Ta | Ca | Mg | Zr | REM | Category |
| A | — | — | — | — | — | — | — | — | — | — | Disclosed steel |
| B | — | — | — | — | — | — | — | — | — | — | Disclosed steel |
| C | — | — | — | — | — | — | — | — | — | — | Disclosed steel |
| D | — | — | — | — | — | — | — | — | — | — | Disclosed steel |
| E | — | — | — | — | — | — | — | — | — | — | Disclosed steel |
| F | — | — | — | — | — | — | — | — | — | — | Disclosed steel |
| G | — | — | — | — | — | — | — | — | — | — | Disclosed steel |
| H | — | — | — | — | — | — | — | — | — | — | Disclosed steel |
| I | — | — | — | — | — | — | — | — | — | — | Disclosed steel |
| J | — | — | — | — | — | — | — | — | — | — | Disclosed steel |
| K | — | — | — | — | — | — | — | — | — | — | Disclosed steel |
| L | — | — | — | — | — | — | — | — | — | — | Disclosed steel |
| M | — | — | — | — | — | — | — | — | — | — | Disclosed steel |
| N | — | — | — | — | — | — | — | — | — | — | Disclosed steel |
| O | — | — | — | — | — | — | — | — | — | — | Disclosed steel |
| P | — | — | — | — | — | — | — | — | — | — | Disclosed steel |
| Q | — | — | — | — | — | — | — | — | — | — | Disclosed steel |
| R | — | — | — | — | — | — | — | — | — | — | Disclosed steel |
| S | — | — | — | — | — | — | — | — | — | — | Disclosed steel |
| T | — | — | — | — | — | — | — | — | — | — | Disclosed steel |
| U | 0.600 | — | — | — | — | — | — | — | — | — | Disclosed steel |
| V | — | 0.061 | — | — | — | — | — | — | — | — | Disclosed steel |
| W | — | — | 0.115 | — | — | — | — | — | — | — | Disclosed steel |
| X | — | — | — | 0.005 | — | — | — | — | — | — | Disclosed steel |
| Y | — | — | — | — | 0.051 | — | — | — | — | — | Disclosed steel |
| Z | — | — | — | — | — | 0.006 | — | — | — | — | Disclosed steel |
| AA | — | — | — | — | — | — | 0.0032 | — | — | — | Disclosed steel |
| AB | — | — | — | — | — | — | — | 0.0035 | — | — | Disclosed steel |

TABLE 2-continued

| | | | | | | | | | | | |
|---|---|---|---|---|---|---|---|---|---|---|---|
| AC | — | — | — | — | — | — | — | — | 0.0032 | — | Disclosed steel |
| AD | — | — | — | — | — | — | — | — | — | 0.0025 | Disclosed steel |
| AE | 18.22 | — | — | — | — | — | — | — | — | — | Disclosed steel |
| AF | 16.31 | — | — | — | — | — | — | — | — | — | Disclosed steel |
| AG | 12.89 | — | — | — | — | — | — | — | — | — | Disclosed steel |
| AH | 21.14 | — | 0.423 | — | — | — | — | — | — | — | Disclosed steel |
| AI | 23.01 | 0.551 | — | — | — | — | — | — | — | — | Disclosed steel |
| AJ | 22.48 | 0.924 | — | — | — | — | — | — | — | — | Disclosed steel |

Marks [—] indicate content of inevitable impurity level.

TABLE 3

| | | | Sound wave irradiation conditions | | | | | Steel sheet | | | | | |
|---|---|---|---|---|---|---|---|---|---|---|---|---|---|
| No. | Steel sample ID | Line | Sound wave irradiation location | Sound pressure level (dB) | Frequency (Hz) | Irradiation time (sec) | Product coil [1)] | TS (MPa) | EL (%) | EL' (%) | Hydrogen embrittlement resistance EL/EL' | Diffusible hydrogen content (mass ppm) | Category |
| 1 | A | CGL | (B-2) | 100 | 1250 | 60 | GA | 1520 | 9.2 | 9.6 | 0.96 | 0.12 | Example |
| 2 | B | CGL | after (C-1) | 120 | 8000 | 90 | GA | 1021 | 22.3 | 24.9 | 0.90 | 0.32 | Example |
| 3 | C | CAL | (B-2) | 95 | 1000 | 180 | CR | 1008 | 24.2 | 26.0 | 0.93 | 0.30 | Example |
| 4 | D | CGL | (B-2) + before (C-1) + after (C-1) | 130 | 90000 | 600 | GI | 2215 | 5.7 | 5.8 | 0.98 | 0.02 | Example |
| 5 | E | CAL | (B-2) | 85 | 42000 | 90 | CR | 602 | 21.2 | 25.9 | 0.82 | 0.20 | Example |
| 6 | F | CAL | (B-2) | 60 | 2500 | 90 | CR | 1054 | 10.8 | 14.0 | 0.77 | 0.39 | Example |
| 7 | G | CGL | (B-2) | 55 | 4000 | 60 | GI | 1832 | 5.9 | 8.1 | 0.73 | 0.42 | Example |
| 8 | H | CGL | (B-2) | 100 | 10000 | 60 | GA | 1175 | 9.3 | 10.3 | 0.90 | 0.14 | Example |
| 9 | I | CGL | (B-2) + before (C-1) | 135 | 500 | 240 | GI | 1523 | 20.8 | 21.0 | 0.99 | 0.02 | Example |
| 10 | J | CGL | (B-2) | 120 | 1000 | 90 | GA | 1020 | 21.0 | 23.2 | 0.91 | 0.17 | Example |
| 11 | K | CGL | after (C-1) | 60 | 1200 | 90 | GI | 1054 | 33.4 | 45.2 | 0.74 | 0.44 | Example |
| 12 | L | CGL | (B-2) + before (C-1) | 115 | 1000 | 180 | GA | 985 | 18.0 | 19.1 | 0.94 | 0.05 | Example |
| 13 | M | CAL | (C) | 120 | 5000 | 240 | CR | 783 | 23.8 | 23.9 | 1.00 | 0.02 | Example |
| 14 | N | CGL | (B-2) + after (C-1) | 90 | 5000 | 180 | GI | 1342 | 11.1 | 12.5 | 0.89 | 0.33 | Example |
| 15 | O | CGL | before (C-1) | 100 | 5000 | 30 | GI | 923 | 20.0 | 24.8 | 0.81 | 0.27 | Example |
| 16 | P | CGL | before (C-1) | 120 | 4000 | 15 | GA | 1280 | 12.3 | 13.0 | 0.95 | 0.09 | Example |
| 17 | Q | CGL | before (C-1) + after (C-1) | 130 | 30000 | 1200 | GI | 945 | 28.0 | 29.6 | 0.95 | 0.02 | Example |
| 18 | R | CAL | (B-2) + (C) | 125 | 50000 | 600 | CR | 1154 | 12.6 | 13.6 | 0.93 | 0.17 | Example |
| 19 | S | CGL | after (C-1) | 85 | 2000 | 120 | GA | 1480 | 10.5 | 12.5 | 0.84 | 0.36 | Example |
| 20 | T | CGL | before (C-1) | 65 | 1000 | 15 | GI | 999 | 14.2 | 18.7 | 0.76 | 0.49 | Example |
| 21 | U | CGL | (B-2) + before (C-1) + after (C-1) | 70 | 1250 | 300 | GA | 1323 | 12.0 | 12.8 | 0.94 | 0.17 | Example |
| 22 | V | CGL | before (C-1) | 90 | 25000 | 15 | GA | 1302 | 10.8 | 13.0 | 0.83 | 0.32 | Example |
| 23 | W | CGL | (B-2) | 100 | 50000 | 30 | GA | 1230 | 14.8 | 16.8 | 0.88 | 0.18 | Example |
| 24 | X | CGL | (B-2) | 115 | 8000 | 60 | GI | 1490 | 9.5 | 10.1 | 0.94 | 0.15 | Example |
| 25 | Y | CGL | (B-2) + before (C-1) | 120 | 10000 | 60 | GA | 1534 | 12.0 | 12.5 | 0.96 | 0.06 | Example |
| 26 | Z | CAL | (B-2) | 125 | 500 | 120 | CR | 1036 | 13.9 | 14.6 | 0.95 | 0.04 | Example |
| 27 | AA | CGL | (B-2) | 120 | 1000 | 30 | GA | 1560 | 15.1 | 16.2 | 0.93 | 0.13 | Example |
| 28 | AB | CAL | (C) | 100 | 1500 | 90 | CR | 1005 | 23.0 | 27.8 | 0.83 | 0.20 | Example |
| 29 | AC | CGL | before (C-1) | 90 | 2000 | 15 | GI | 1342 | 13.8 | 15.0 | 0.92 | 0.09 | Example |
| 30 | AD | CGL | (B-2) + before (C-1) | 80 | 2500 | 120 | GA | 1329 | 12.0 | 14.2 | 0.85 | 0.26 | Example |
| 31 | AE | CAL | (B-2) + (C) | 130 | 2000 | 600 | CR | 618 | 48.1 | 48.5 | 0.99 | 0.05 | Example |
| 32 | AF | CAL | (B-2) + (C) | 120 | 1500 | 300 | CR | 601 | 27.5 | 28.2 | 0.98 | 0.08 | Example |
| 33 | AG | CAL | (B-2) | 110 | 1750 | 150 | CR | 598 | 21.6 | 22.3 | 0.97 | 0.10 | Example |
| 34 | AH | CAL | (B-2) + (C) | 130 | 1350 | 3000 | CR | 591 | 24.4 | 24.5 | 1.00 | 0.00 | Example |
| 35 | AI | CAL | (B-2) + (C) | 125 | 2500 | 900 | CR | 592 | 23.0 | 23.6 | 0.97 | 0.03 | Example |
| 36 | AJ | CAL | (B-2) | 120 | 12000 | 180 | CR | 594 | 20.8 | 21.2 | 0.98 | 0.01 | Example |
| 37 | A | CAL | — | — | — | — | CR | 1521 | 3.8 | 10.9 | 0.35 | 0.66 | Comparative Example |
| 38 | A | CGL | (B-2) + before (C-1) | 25 | 5000 | 60 | GA | 1550 | 7.8 | 14.2 | 0.55 | 0.71 | Comparative Example |
| 39 | A | CGL | (B-2) | 65 | 3000 | 90 | GA | 1268 | 7.7 | 10.5 | 0.73 | 0.29 | Example |
| 40 | A | CGL | (B-2) + before (C-1) | 82 | 2200 | 120 | GA | 1310 | 8.2 | 10.0 | 0.82 | 0.15 | Example |
| 41 | A | CGL | (B-2) + before (C-1) | 101 | 1300 | 150 | GA | 1289 | 10.1 | 10.3 | 0.98 | 0.02 | Example |
| 42 | A | CGL | (B-2) | 110 | 95000 | 30 | GA | 1623 | 7.2 | 8.5 | 0.85 | 0.19 | Example |
| 43 | A | CGL | before (C-1) + after (C-1) | 125 | 120 | 180 | GI | 1498 | 13.0 | 13.2 | 0.98 | 0.04 | Example |

TABLE 3-continued

| | | | Sound wave irradiation conditions | | | | | Steel sheet | | | | | |
|---|---|---|---|---|---|---|---|---|---|---|---|---|---|
| No. | Steel sample ID | Line | Sound wave irradiation location | Sound pressure level (dB) | Frequency (Hz) | Irradiation time (sec) | Product coil [1)] | TS (MPa) | EL (%) | EL' (%) | Hydrogen embrittlement resistance EL/EL' | Diffusible hydrogen content (mass ppm) | Category |
| 44 | A | CGL | (B-2) + before (C-1) + after (C-1) | 130 | 75000 | 300 | GA | 1487 | 14.5 | 14.6 | 0.99 | 0.03 | Example |
| 45 | A | CGL | (B-2) + before (C-1) + after (C-1) | 120 | 1250 | 3200 | GI | 1589 | 9.9 | 10.0 | 0.99 | 0.02 | Example |

Underlines indicate outside the range according to the present disclosure.

[1)] CR: cold-rolled steel sheet, GI: hot-dip galvanized steel sheet (without alloying treatment of galvanizing), GA: galvannealed steel sheet

INDUSTRIAL APPLICABILITY

It is thus possible to provide a continuous annealing line, a continuous hot-dip galvanizing line, and a steel sheet production method capable of producing a steel sheet excellent in hydrogen embrittlement resistance without changing the mechanical properties and without impairing the production efficiency.

REFERENCE SIGNS LIST

100 continuous annealing line
200 continuous hot-dip galvanizing line
300 continuous hot-dip galvanizing line
10 payoff reel
11 welder
12 cleaning line
13 entry looper
20 annealing furnace
22 heating zone
24 soaking zone
26 cooling zone
26A cooling nozzle
28 overaging treatment zone
29 snout
30 downstream line
31 hot-dip galvanizing bath
32 gas wiping device
33 alloying furnace
34 cooling device
35 exit looper
36 temper mill
50 tension reel
60 sound wave irradiator
61 controller
62 sound wave oscillator
64 vibration transducer
66 booster
68 horn
69 sound level meter
C cold-rolled coil
S cold-rolled steel sheet
P product coil

The invention claimed is:

1. A steel sheet production method comprising, in the following order:

a step (A) of uncoiling a cold-rolled coil to feed a cold-rolled steel sheet by a payoff reel;

a step (B) of passing the cold-rolled steel sheet through an annealing furnace in which a heating zone, a soaking zone, and a cooling zone are arranged in said order in a sheet passing direction, to continuously anneal the cold-rolled steel sheet by a step (B-1) of annealing the cold-rolled steel sheet in a reducing atmosphere containing hydrogen in the heating zone and the soaking zone and a step (B-2) of cooling the cold-rolled steel sheet in the cooling zone;

a step (C) of continuously passing the cold-rolled steel sheet discharged from the annealing furnace, the step (C) including a step (C-1) of immersing the cold-rolled steel sheet in a hot-dip galvanizing bath located downstream of the annealing furnace in the sheet passing direction to apply a hot-dip galvanized coating onto the cold-rolled steel sheet; and a step (D) of coiling the cold-rolled steel sheet by a tension reel to obtain a product coil, wherein the steel sheet production method comprises a sound wave irradiation step of irradiating the cold-rolled steel sheet being passed downstream of the hot-dip galvanizing bath after the step (C-1) and before the step (D) with sound waves so that a sound pressure level at a surface of the cold-rolled steel sheet will be 30 dB or more.

2. The steel sheet production method according to claim 1, wherein the step (C) includes, following the step (C-1), a step (C-2) of passing the cold-rolled steel sheet through an alloying furnace located downstream of the hot-dip galvanizing bath in the sheet passing direction to heat and alloy the hot-dip galvanized coating.

3. The steel sheet production method according to claim 1, wherein the sound waves have a frequency from 10 Hz to 100000 Hz.

4. The steel sheet production method according to claim 1, wherein in the sound wave irradiation step, a sound wave irradiation time for the cold-rolled steel sheet is 1 second or more.

5. The steel sheet production method according to claim 1, wherein the cold-rolled steel sheet is a high strength steel sheet having a tensile strength of 590 MPa or more.

6. The steel sheet production method according to claim 1, wherein the cold-rolled steel sheet has a chemical composition containing, in mass %, C: 0.030% to 0.800%,
Si: 0.01% to 3.00%,
Mn: 0.01% to 10.00%,
P: 0.001% to 0.100%,
S: 0.0001% to 0.0200%,
N: 0.0005% to 0.0100%, and
Al: 0.001% to 2.000%,
with the balance being Fe and inevitable impurities.

7. The steel sheet production method according to claim 6, wherein the chemical composition further contains, in mass %, at least one element selected from the group consisting of Ti: 0.200% or less,
Nb: 0.200% or less,
V: 0.500% or less,
W: 0.500% or less,
B: 0.0050% or less,
Ni: 1.000% or less,
Cr: 1.000% or less,
Mo: 1.000% or less,
Cu: 1.000% or less,
Sn: 0.200% or less,
Sb: 0.200% or less,
Ta: 0.100% or less,
Ca: 0.0050% or less,
Mg: 0.0050% or less,
Zr: 0.1000% or less, and
REM: 0.0050% or less.

8. The steel sheet production method according to claim 1, wherein the product coil has a diffusible hydrogen content of 0.50 mass ppm or less.

* * * * *